US006892641B2

(12) United States Patent
Aoki

(10) Patent No.: US 6,892,641 B2
(45) Date of Patent: May 17, 2005

(54) PLATE HOLDING APPARATUS

(75) Inventor: Takanobu Aoki, Ibaraki (JP)

(73) Assignee: Komori Corporation, Tokyo (JP)

( * ) Notice: Subject to any disclaimer, the term of this patent is extended or adjusted under 35 U.S.C. 154(b) by 39 days.

(21) Appl. No.: 10/410,631

(22) Filed: Apr. 7, 2003

(65) Prior Publication Data

US 2003/0188658 A1 Oct. 9, 2003

(30) Foreign Application Priority Data

Apr. 8, 2002 (JP) ..... 2002-105798

(51) Int. Cl.[7] ..... B41L 47/14; B41F 21/00

(52) U.S. Cl. ..... 101/477; 101/415.1; 101/216; 101/383; 101/DIG. 36

(58) Field of Search ..... 101/216, 378, 101/382.1, 383, 415.1, 477, DIG. 36, 375

(56) References Cited

U.S. PATENT DOCUMENTS 5,127,328 A * 7/1992 Wieland ..... 101/415.1
5,440,988 A * 8/1995 Ito ..... 101/477
5,555,812 A * 9/1996 Ruckmann et al. ..... 101/477
5,634,406 A 6/1997 Lindner et al.
5,758,578 A * 6/1998 Metrope ..... 101/477
6,321,653 B1 * 11/2001 Kobayashi et al. ..... 101/477
6,443,060 B2 * 9/2002 Gottling et al. ..... 101/216
6,467,412 B1 * 10/2002 Tobe et al. ..... 101/477
6,502,507 B2 * 1/2003 Tobe ..... 101/216
6,601,511 B1 * 8/2003 Tobe ..... 101/477
6,644,188 B2 * 11/2003 Kolbe et al. ..... 101/375

FOREIGN PATENT DOCUMENTS

| | | |
|---|---|---|
| EP | 0655350 | 5/1995 |
| EP | 0667237 | 8/1995 |
| JP | 2000255031 | 9/2000 |
| JP | 2000-255031 A | 9/2000 |

* cited by examiner

*Primary Examiner*—Andrew H. Hirshfeld
*Assistant Examiner*—Marissa Ferguson
(74) *Attorney, Agent, or Firm*—Blakely Sokoloff Taylor & Zafman

(57) ABSTRACT

A plate holding apparatus includes a plate holding device and an air cylinder. The plate holding device holds an old plate discharged from a plate cylinder. The air cylinder moves the plate holding device between the first position of holding the discharged old plate and the second position away from the plate cylinder. The plate holding device includes a support member, first and second rotary members, a lever, stopper, and tensile coil spring, and a one-way clutch. The first rotary member is rotatably, axially supported by the support member. The second rotary member is axially supported by the support member to be movable and rotatable. The lever, stopper, and tensile coil spring move the second rotary member to come into contact with and separate from the first rotary member. When the old plate is held by the first and second rotary members, the one-way clutch allows at least one of the first and second rotary members to rotate in the first direction to disengage the old plate from the plate cylinder, and regulates it from rotating in the second direction opposite to the first direction.

8 Claims, 29 Drawing Sheets

PLATE HOLDING APPARATUS

BACKGROUND OF THE INVENTION

The present invention relates to a plate holding apparatus for removing an old plate from a plate cylinder during plate exchange.

A plate holding apparatus of this type is disclosed in Japanese Patent Laid-Open No. 2000-255031(reference 1). The apparatus disclosed in reference 1 has a bracket which is provided in a magazine that collects an old plate and is moved vertically by a driving means, a stationary roller pivotally supported by the bracket, and a movable roller which can come into contact and separate from the stationary roller and is brought into contact opposite to the stationary roller by a biasing means. When the bracket is located at a lower position, the movable roller separates from the stationary roller. When the bracket moves upward, the movable roller is brought into contact opposite to the stationary roller by the biasing force of the biasing means.

In this arrangement, when one end of the plate is released by the plate clamp device of a plate cylinder, the released one end of the plate is fed to a portion between the stationary roller and movable roller. Then, when the bracket moves upward, the movable roller is brought into contact opposite too the stationary roller by the biasing force of the biasing means, so that the two rollers hold one end of the plate. The held plate moves upward as the bracket moves upward, and is discharged.

In the conventional plate holding apparatus described above, when the plate held by the movable roller and stationary roller moves upward, the two rollers are sometimes rotated in directions opposite to the discharge direction by the weight of the plate itself, or by a force that acts in a direction opposite to the plate removing direction due to the frictional force occurring between the plate and the plate clamp when the plate is to be removed from the plate clamp. In this case, the plate deforms to flex so as not to disengage from the plate cylinder, and accordingly the elastic restoration force of the plate may undesirably break the plate holding device. Also, the deformed plate may undesirably enter an ink form roller in contact opposite to the plate cylinder, to damage it.

SUMMARY OF THE INVENTION

It is an object of the present invention to provide a plate holding apparatus which prevents the apparatus itself, the roller, or the like from being broken or damaged.

In order to achieve the above object, according to the present invention, there is provided a plate holding apparatus comprising plate holding means for holding an old plate discharged from a plate cylinder, and driving means for moving the plate holding means between a first position of holding the discharged old plate and a second position away from the plate cylinder, wherein the plate holding means comprises a support member, a first rotary member rotatably, axially supported by the support member, a second rotary member axially supported by the support member to be movable and rotatable, moving means for moving the second rotary member to come into contact with and separate from the first rotary member, and a one-way clutch which, while the old plate is being held by the first and second rotary members, allows at least one of the first and second rotary members to rotate in a first direction to disengage the old plate from the plate cylinder, and regulates at least one of the first and second rotary members from rotating in a second direction opposite to the first direction.

DESCRIPTION OF THE PREFERRED EMBODIMENT

Figure 1:
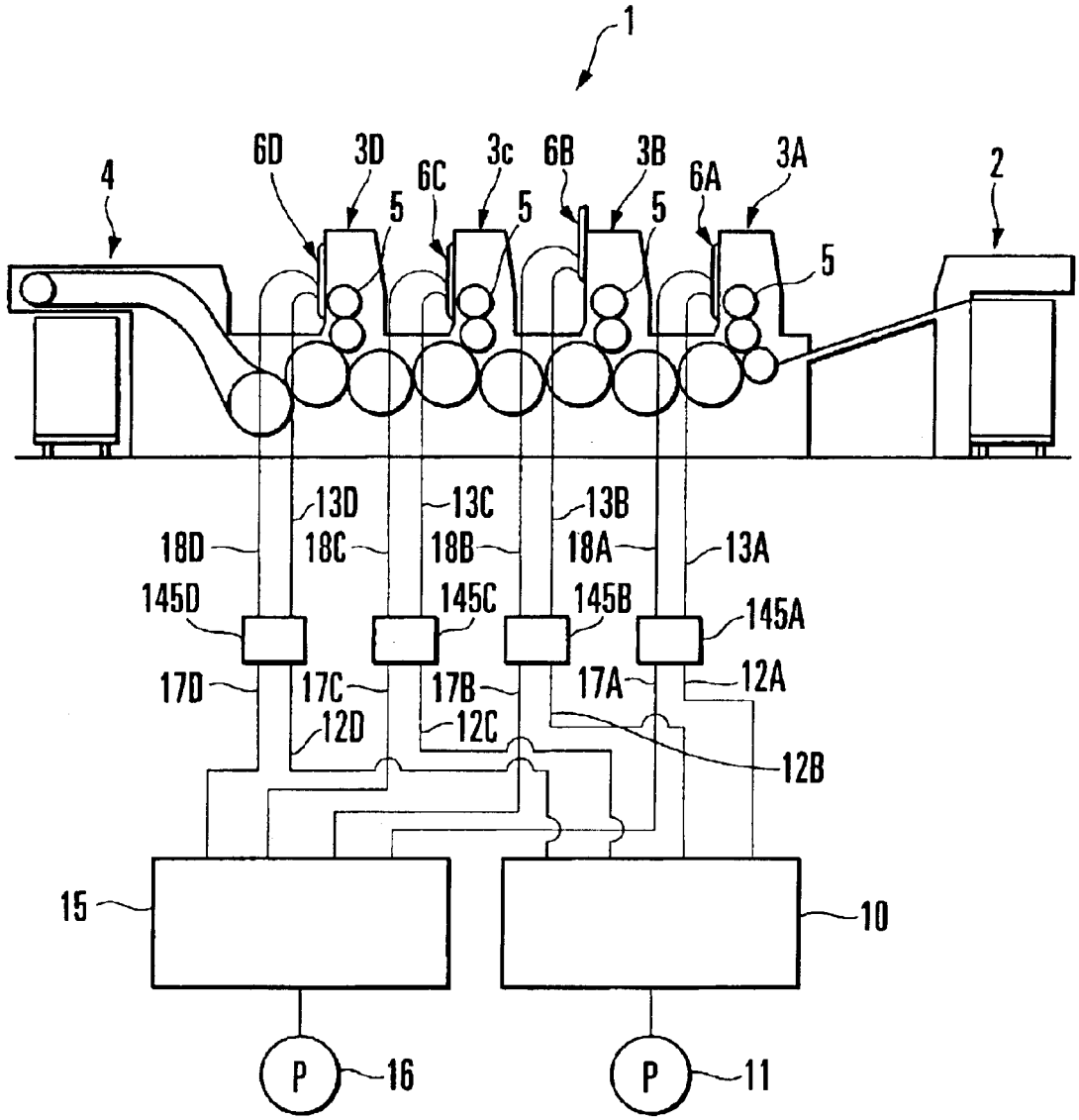
FIG. 1 is a schematic view showing the arrangement of a sheet-fed rotary printing press which has a plate holding apparatus according to the present invention.

A plate holding apparatus according to an embodiment of the present invention will be described with reference to FIGS. 1 to 29. As shown in FIG. 1, a sheet-fed rotary printing press 1 has a feeder 2 for feeding sheets, printing units 3A to 3D of four different colors for printing on the fed sheets, and a delivery unit 4 where the sheets discharged from the printing unit 3D are stacked. A plate cylinder 5 which is rotatably held by a pair of opposing frames and on which a plate is mounted is provided in each of the printing units 3A to 3D. Safety covers 6A to 6D serving as movable members are provided on the delivery sides of the printing units 3A to 3D, respectively. The safety covers 6A to 6D are supported by the respective printing units 3A to 3D such that they can be vertically moved by air cylinders 30. When each one of the safety covers 6A to 6D moves upward, it opens the front portion of the corresponding plate cylinder 5. When each one of the safety covers 6A to 6*d* moves downward, it covers the front portion of the corresponding plate cylinder 5.

A cylinder controller 10 for a plate feed unit is provided between a suction pump 11 and respective air tubes 12A to 12D. The cylinder controller 10 selectively supplies suction air from the suction pump 11 to suction pads 102 (FIG. 10) of plate feed units 100 provided in the printing units 3A to 3D through the air tubes 12A to 12D, disconnecting/connecting devices 145A to 145D, and air tubes 13A to 13D.

A cylinder controller 15 for the plate holding device is provided between a discharge pump 16 and the respective air tubes 17A to 17D. The cylinder controller 15 selectively supplies discharged air from the discharge pump 16 to air cylinders 41 (FIG. 3) of plate holding devices 40A and 40B provided in the respective printing units 3A to 3D, and air cylinders 113 (FIG. 3) through air tubes 17A to 17D, the disconnecting/connecting devices 145A to 145D, and air tubes 18A to 18D. The air cylinders 113 cause the suction pads 102 to come into contact with or separate from the plate cylinder 5.

Figure 2A:
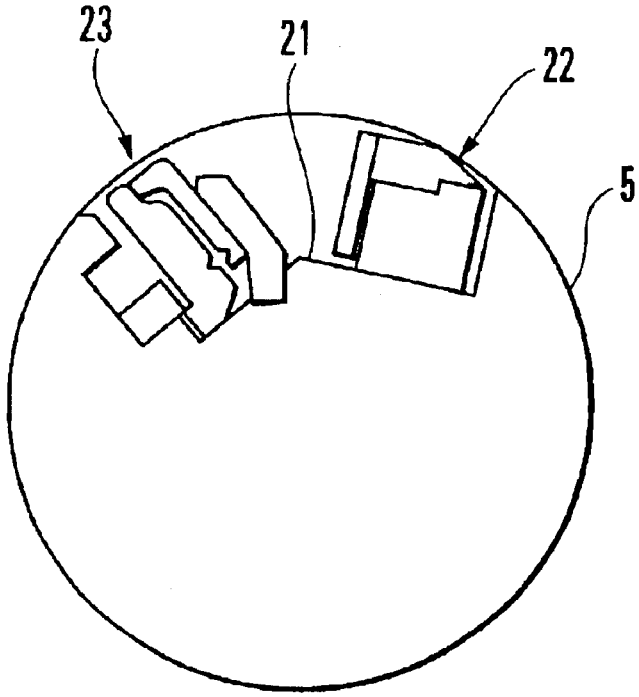
FIG. 2A is a schematic side view showing the structure of a plate cylinder in the sheet-fed rotary printing press shown in FIG. 1.
Figure 2B:
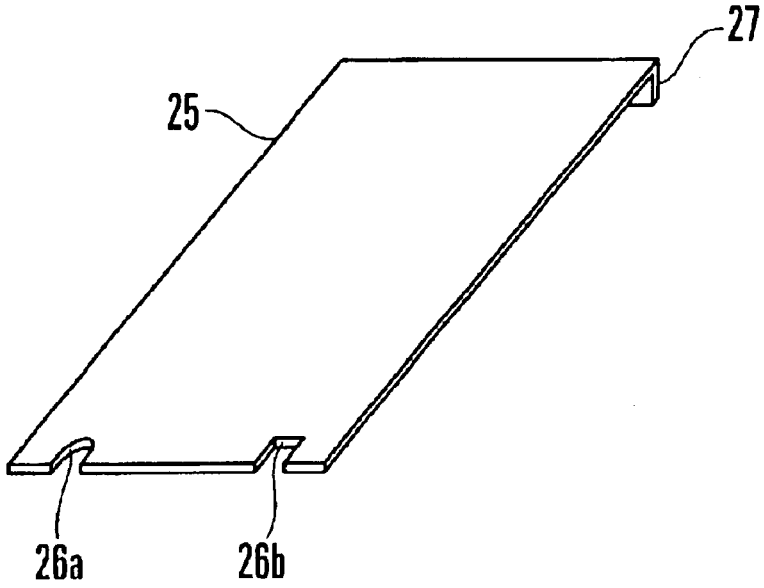
FIG. 2B is a perspective view of a plate used in the sheet-fed rotary printing press shown in FIG. 1.

A notch 21 extending in the direction of the cylinder axis is formed in part of the outer surface of the plate cylinder 5, as shown in FIG. 2A. A leading edge plate clamp device 22 and trailing edge plate clamp device 23 are provided in the notch 21. As shown in FIG. 2B, the leading edge of a plate 25 has a U-shaped positioning notch 26*a* having an arcuate bottom, and a rectangular positioning notch 26*b*. The plate 25 has a bent portion 27, bent at a right angle, at its trailing edge.

Figure 3:
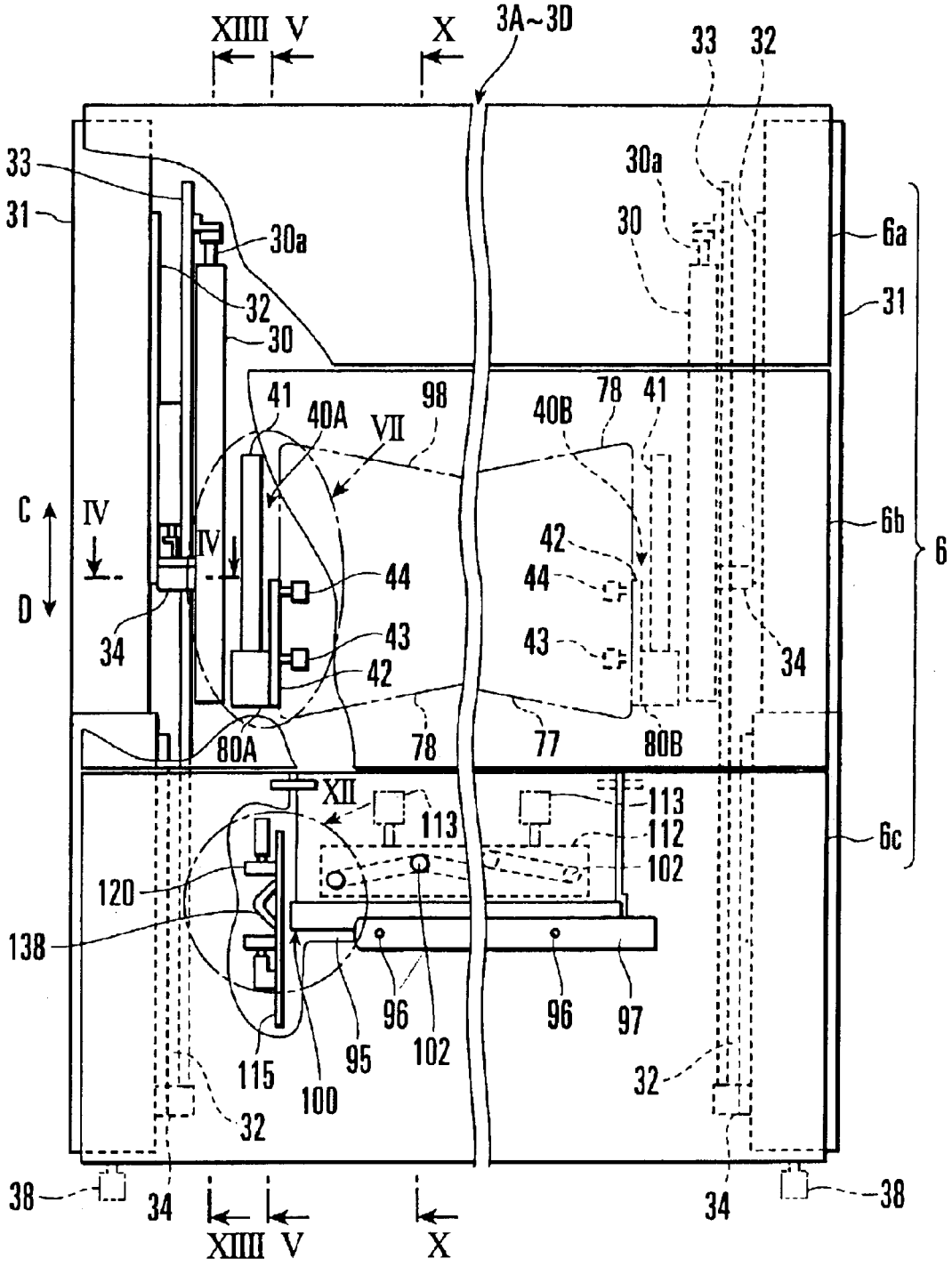
FIG. 3 is a partially cutaway front view showing a printing unit that forms the sheet-fed rotary printing press shown in FIG. 1.

The safety cover 6 will be described with reference to FIGS. 3 and 4. As shown in FIG. 3, the safety cover 6 is comprised of three covers, i.e., upper, middle, and lower covers 6*a*, 6*b*, and 6*c*. The three covers 6*a*, 6*b*, and 6*c* are sequentially connected to each other, and are integrally moved by the corresponding air cylinder 30 vertically.

More specifically, two pairs of guide bars 32 extending vertically are fixed to the opposing side surfaces of a pair of frames 31 of each of the printing units 3A to 3D. As shown in FIG. 4, guide grooves 32*a* each with a V-shaped section are formed in the opposing surfaces of the guide bars 32 to extend vertically (direction of arrows C–D). The covers 6*a*, 6*b*, and 6*c* are fixed to a pair of vertically extending movable bars 33 through support members (not shown).

Figure 4:
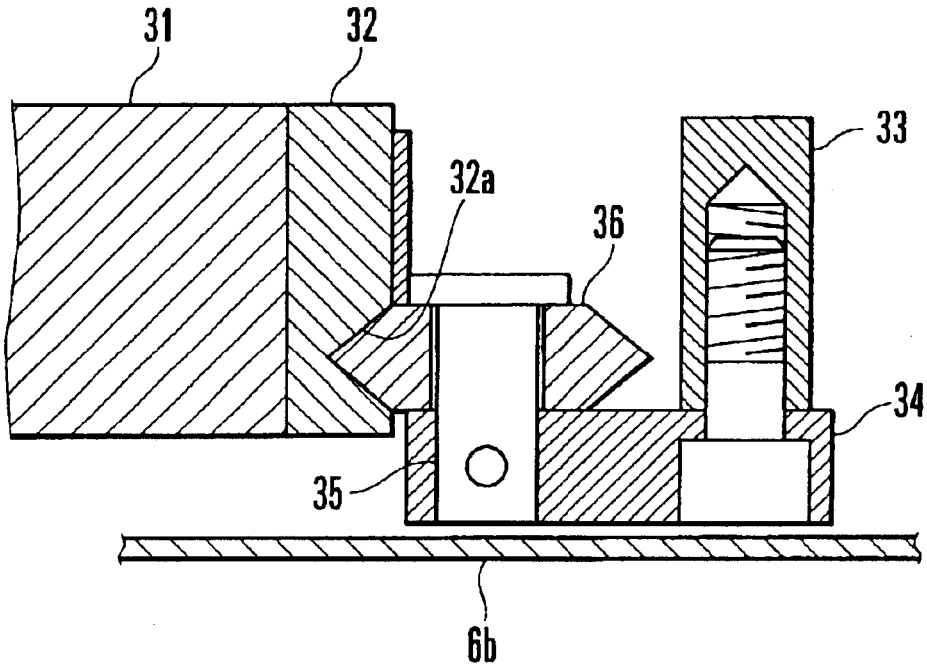
FIG. 4 is a sectional view taken along the line IV—IV of FIG. 3.
Figure 5:
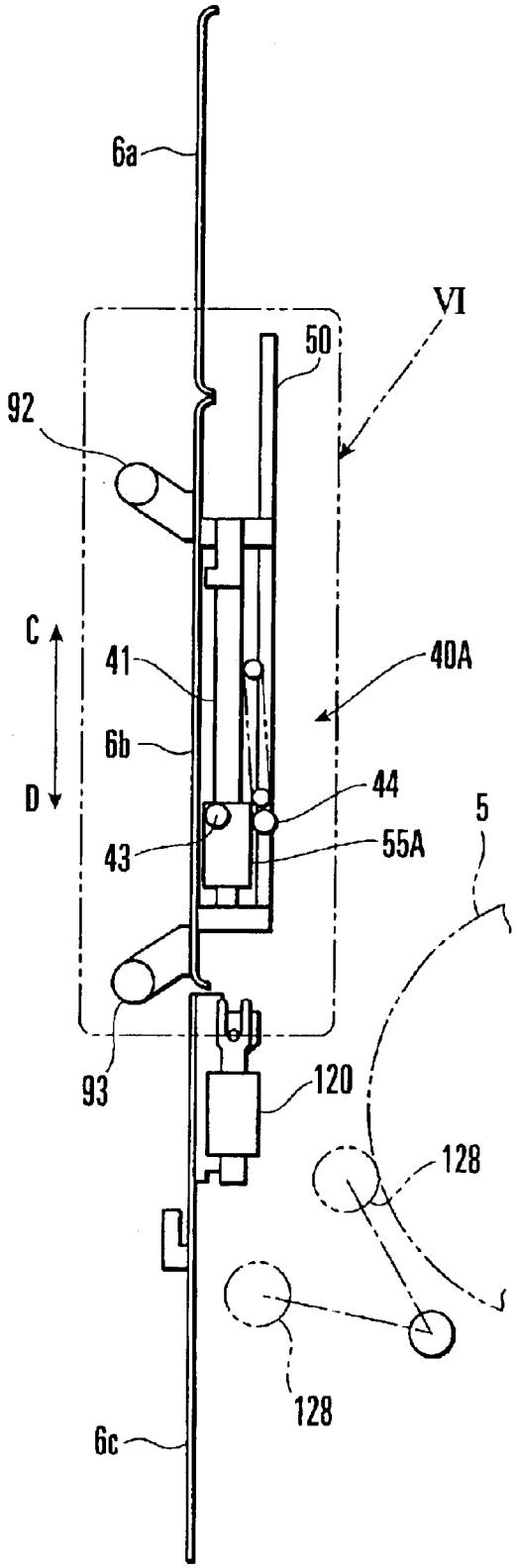
FIG. 5 is a sectional view taken along the line V—V of FIG. 3.

As shown in FIG. 4, one end of each of four connecting members 34 is fixed to a corresponding one of the upper and lower ends of the movable bars 33. A roller 36 engageable with a guide groove 32*a* of the corresponding guide bar 32 is rotatably supported by a shaft 35 vertically standing from the other end of each connecting member 34. The movable bars 33 are supported by the guide bars 32 and guide members (not shown) to be vertically movable.

As shown in FIG. 3, the lower ends of the air cylinders 30 are fixed to the inner sides of the pair of frames 31 through support members (not shown), and the upper ends of rods 30*a* of the air cylinders 30 are fixed to the movable bars 33. When the rods 30*a* move forward, the safety cover 6 moves upward through the movable bars 33, to open the front surface of the plate cylinder 5. When detection switches 38 detect the lower end of the lower cover 6*c* of the safety cover 6, they output switching signals for air cylinder driving solenoid valves 160 and 163 (FIGS. 17A to 17D). When the switching signals are output, the driving solenoid valve 160 performs switching a port P from a port A to a port B, and the switching solenoid valve 163 performs switching a port P from a port $P_1$ to a port $P_2$. The plate holding devices 40A and 40B are attached to the middle cover 6*b* of the safety cover 6, and the plate feed unit 100 is swingably supported by the lower cover 6*c*.

The plate holding apparatus will be described with reference to FIG. 3 and FIGS. 5 to 9. As shown in FIG. 3, a pair of plate holding devices 40A and 40B are provided inside the middle cover 6*b*, and move as the middle cover 6*b* moves vertically (direction of arrows C–D). As the pair of plate holding devices 40A and 40B have the same structure using the same constituent components, one plate holding device 40A will be described. The other plate holding device 40B will be additionally described when necessary.

Figure 6:
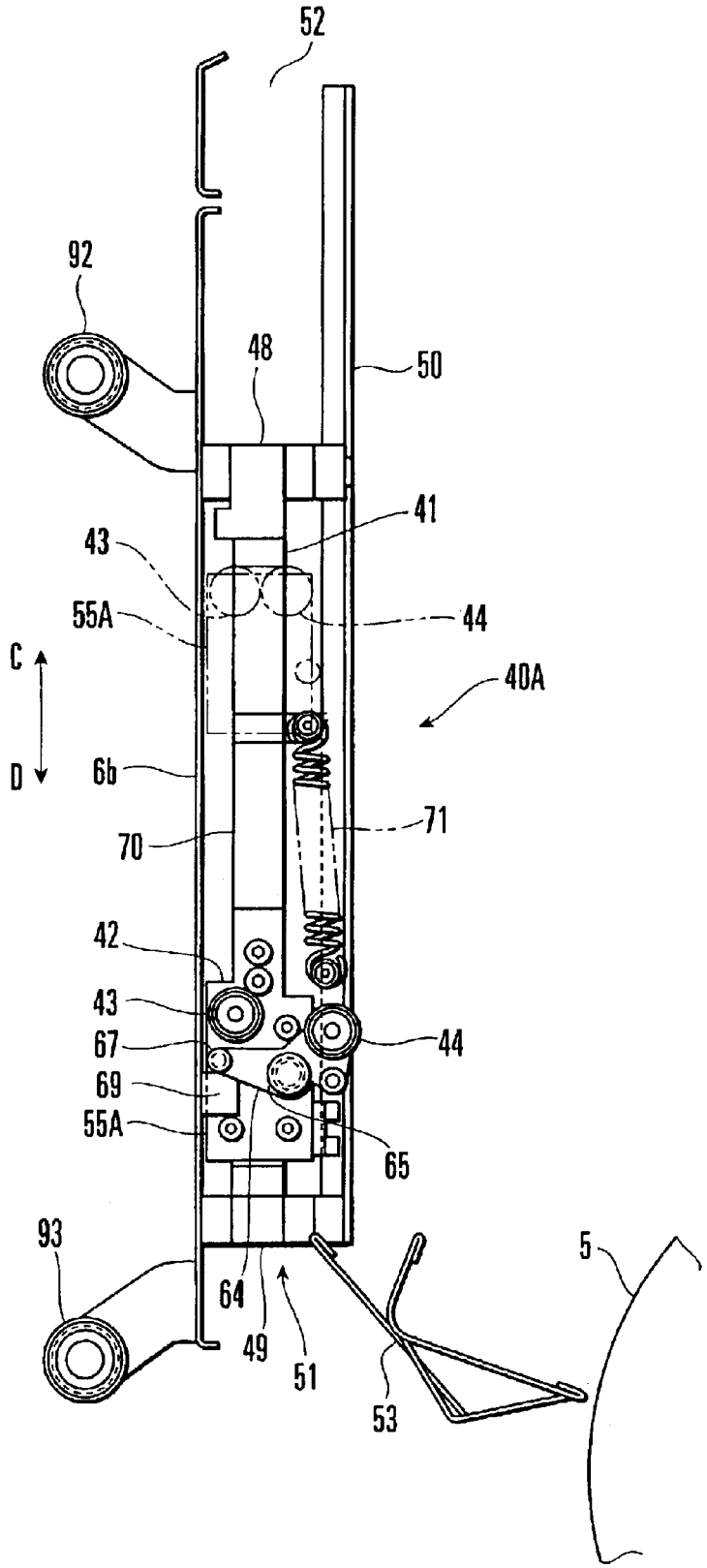
FIG. 6 is an enlarged view of a portion VI of FIG. 5.
Figure 7:
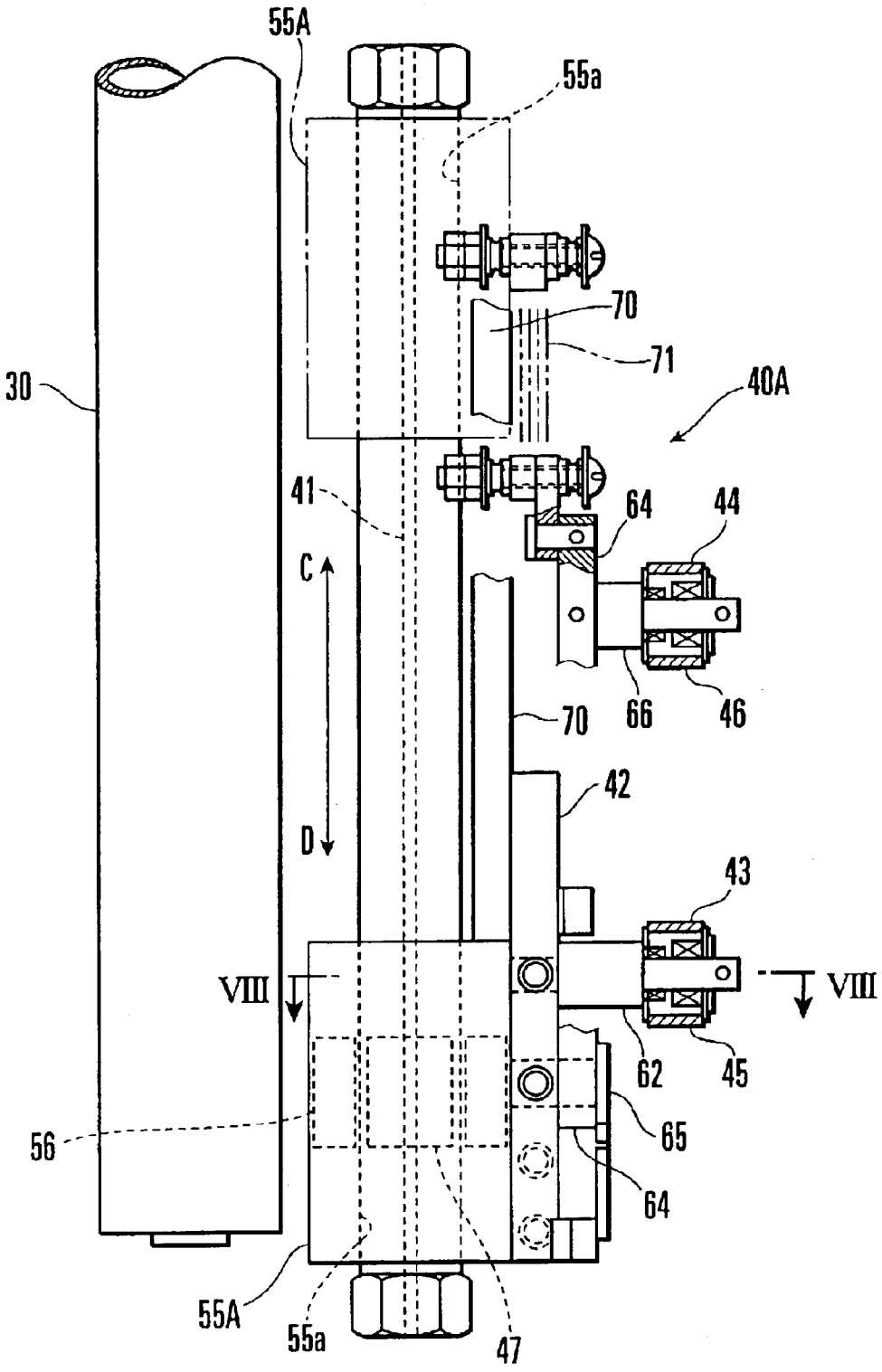
FIG. 7 is an enlarged view of a portion VII of FIG. 3.

As shown in FIGS. 6 and 7, the plate holding device 40A is comprised of a support member 42 which is moved by the air cylinder 41 as a plate handling device actuating member to come close to and separate from the plate cylinder 5, a first rotary member 43 rotatably, axially supported by the support member 42, a second rotary member 44 which can come close to and separate from the first rotary member 43, and one-way clutches 45 and 46 which regulate the rotational directions of the first and second rotary members 43 and 44.

Different from the air cylinder 30, the air cylinder 41 is a so-called rodless air cylinder in which a movable magnet 47 is vertically moved by discharge air supplied from the discharge pump 16. As shown in FIG. 6, the air cylinder 41 extends vertically to be parallel to the middle cover 6*b*. The upper and lower ends of the air cylinder 41 are both fastened to the middle cover 6*b* together with a guide plate 50 through brackets 48 and 49.

The guide plate 50 is parallel to the middle cover 6*b* at a distance from it and extends vertically. The lower end of the guide plate 50 and the middle cover 6*b* forms an insertion port 51 through which an old plate 25A is to be inserted, and the upper end of the guide plate 50 and the middle cover 6*b* forms a discharge port 52 through which the old plate 25A is to be discharged. A guide member 53 is provided under the insertion port 51, and guides the trailing edge of the old plate 25A released by the trailing edge plate clamp device 23 of the plate cylinder 5 to the insertion port 51.

As shown in FIG. 7, a rectangular parallelepiped movable element 55A is supported by the air cylinder 41 to be vertically movable, and has a fitting insertion hole 55*a* at its center where the air cylinder 41 is to be fitted and inserted. An annular magnet 56 is buried in the movable element 55A to surround the movable magnet 47. When the movable magnet 47 moves vertically, the magnet 56 is attracted by it so the movable element 55A moves vertically.

Figure 8:
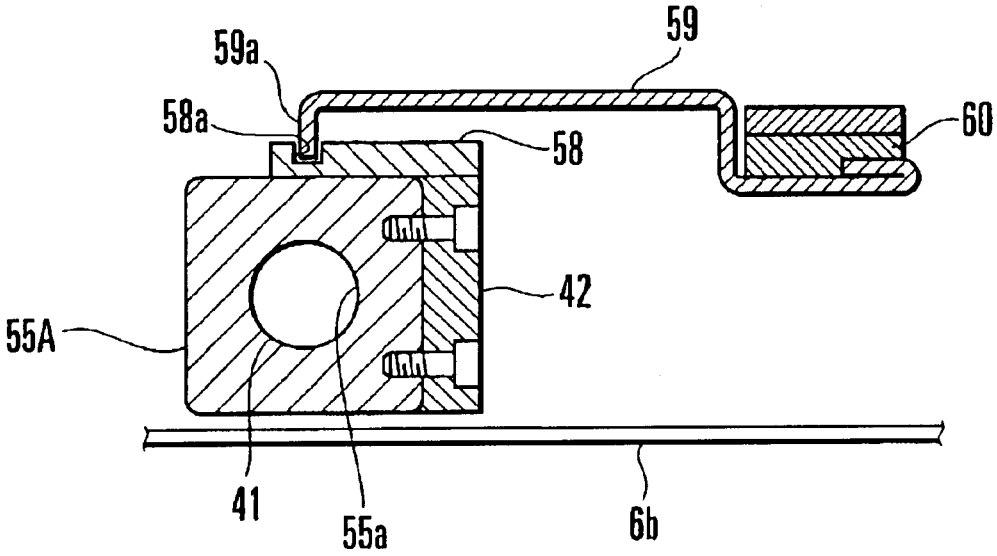
FIG. 8 is a sectional view taken along the line VIII—VIII of FIG. 7.

As shown in FIG. 8, an attached plate 58 having a vertically extending groove 58*a* is fixed to one side surface of the movable element 55A. A vertically extending rotation preventive metal fixture 59 is fixed at its one end to the frame 31 through a support plate 60, and has a bent portion 59*a* at its other end. The bent portion 59*a* is engaged in the groove 58*a* of the attached plate 58, to regulate the movable element 55A from rotating about the axis of the air cylinder 41.

As shown in FIGS. 6 and 8, the flat plate-like support member 42 is fixed to the other surface of the movable element 55A to be perpendicular to the middle cover 6*b*. As shown in FIG. 7, the first rotary member 43 is rotatably, axially supported by a shaft 62 standing perpendicularly from the support member 42. The one-way clutch 45 is interposed between the first rotary member 43 and the shaft 62. The one-way clutch 45 allows the first rotary member 43 to rotate only counterclockwise in FIG. 6, and regulates it from rotating clockwise in FIG. 6.

The center of a lever 64 having a V shape when seen from its side surface is pivotally, axially supported by a small shaft 65 standing perpendicularly from the support member 42. The second rotary member 44 is rotatably, axially supported by a small shaft 66 (FIG. 7) standing perpendicularly from one end of the lever 64, and a roller 67 is rotatably, axially supported by the other end of the lever 64. The one-way clutch 46 is interposed between the second rotary member 44 and the small shaft 66. The one-way clutch 46 allows the second rotary member 44 to rotate only clockwise in FIG. 6, and regulates it from rotating counterclockwise in FIG. 6. Therefore, when the second rotary member 44 is in contact opposite to the first rotary member 43 so the two rotary members 43 and 44 hold the old plate 25A, the one-way clutches 45 and 46 allow the rotary members 43 and 44 to rotate in the directions to remove the old plate 25A from the plate cylinder 5, and regulate them from rotating in directions opposite to the removing direction.

The roller 67 is in contact opposite to the stopper 69 fixed to the inside of the middle cover 6*b*, as shown in FIG. 6. A spring catching member 70 extending upward is fixed to the upper end of the support member 42. A tensile coil spring 71 extends between the upper end of the spring catching member 70 and one end of the lever 64. The tensile force of the tensile coil spring 71 biases the lever 64 counterclockwise in FIG. 6 about the small shaft 65 as the pivot center. Thus, the roller 67 comes into contact opposite to the stopper 69, and the second rotary member 44 separates from the first rotary member 43.

From this state, as the movable element 55A moves upward (direction of arrow C), when the support member 42 moves upward, the lever 64 also moves upward. At this time, while the roller 67 is in contact opposite to the stopper 69, the lever 64 is pivoted counterclockwise about the small shaft 65 as the pivot center by the tensile force of the tensile coil spring 71. When the movable element 55A moves further upward and the roller 67 separates from the stopper 69, the second rotary member 44 which is pivoted counterclockwise by the tensile force of the tensile coil spring 71 abuts against the first rotary member 43, so the pivot operation is stopped.

The position of the support member 42 when the second rotary member 44 is in tight contact with the first rotary member 43 will be referred to as the first position hereinafter for the sake of descriptive convenience. The position the movable element 55A has reached when it moves to the upper limit, which is indicated by an alternate long and two short dashed line in FIG. 6, will be referred to as the second position hereinafter for the sake of descriptive convenience. The roller 67, the lever 64, the stopper 69, the tensile coil spring 71, and the air cylinder 41 which moves the lever 64 form a moving means that can bring the second rotary member 44 into contact with and can separate it from the first rotary member 43.

Figure 9:
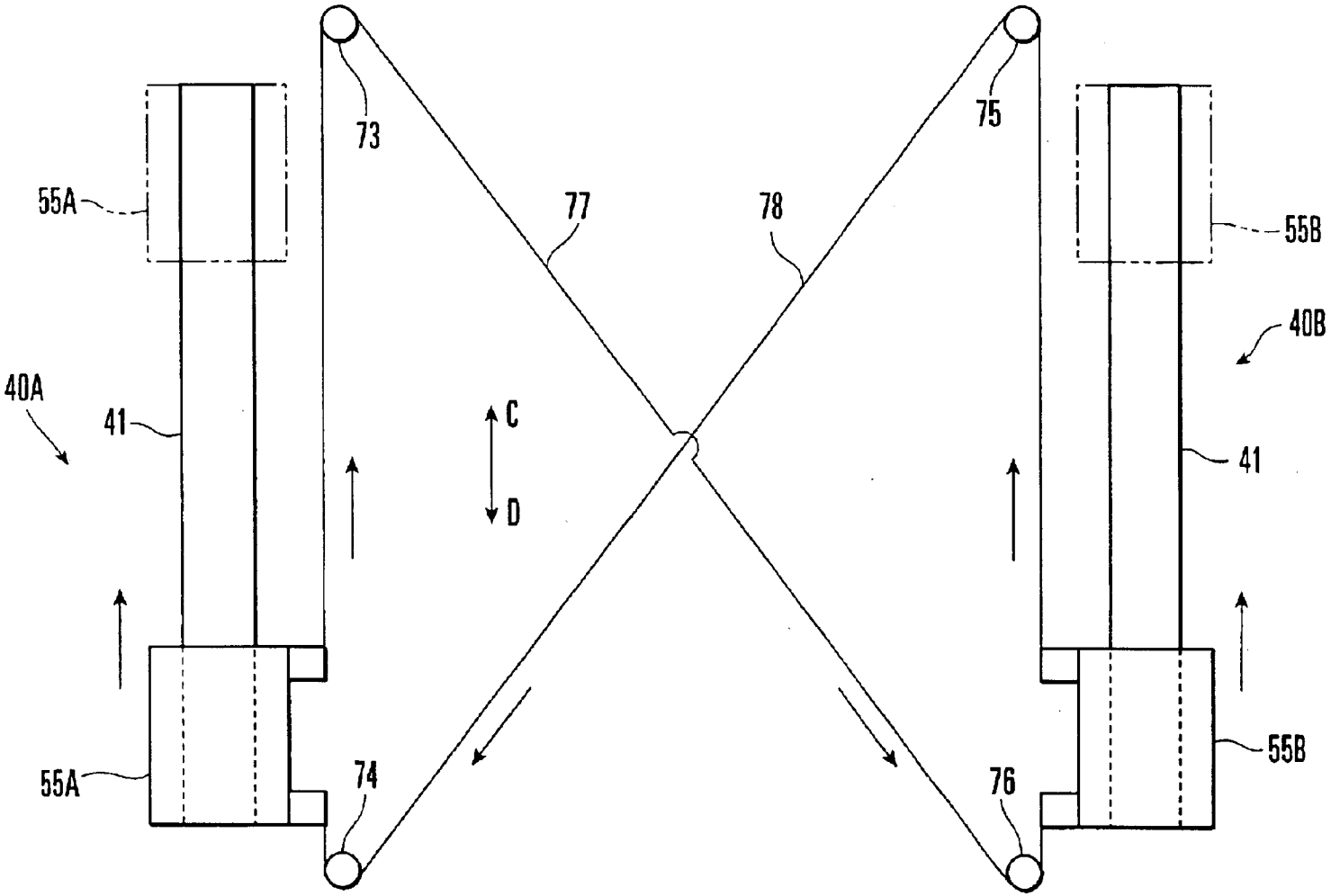
FIG. 9 is a view for explaining the vertical movement of the plate holding apparatus according to the present invention.

So far the plate holding device 40A has been described. The relationship between the pair of plate holding devices 40A and 40B will now be described. As shown in FIG. 9, on sides where the movable element 55A and a movable element 55B oppose each other, rollers 73 and 74 are rotatably, axially supported by the middle cover 6*b* at positions corresponding to the moving end limits of the vertical movement of the movable element 55A, and rollers 75 and 76 are rotatably, axially supported by the middle cover 6*b* at positions corresponding to the moving end limits of the vertical movement of the movable element 55B. The rollers 73 and 75 oppose each other, and the rollers 74 and 76 oppose each other.

A wire 77 extends obliquely between the upper end of the movable element 55A and the lower end of the movable element 55B through the rollers 73 and 76. A wire 78 extends obliquely between the lower end of the movable element 55A and the upper end of the movable element 55B through the rollers 74 and 75. In other words, the two wires 77 and 78 connect the pair of movable elements 55A and 55B in a cross-link manner.

Thus, when the movable element 55A moves upward, the movable element 55B also moves upward interlocked with the movable element 55A through the wire 78, so the two movable elements 55A and 55B move in synchronism with each other. When the movable element 55A moves downward, the movable element 55B also moves downward interlocked with the movable element 55A through the wire 77, so the two movable elements 55A and 55B move in synchronism with each other. Hence, the two movable elements 55A and 55B vertically move simultaneously while maintaining the same height.

Figure 10:
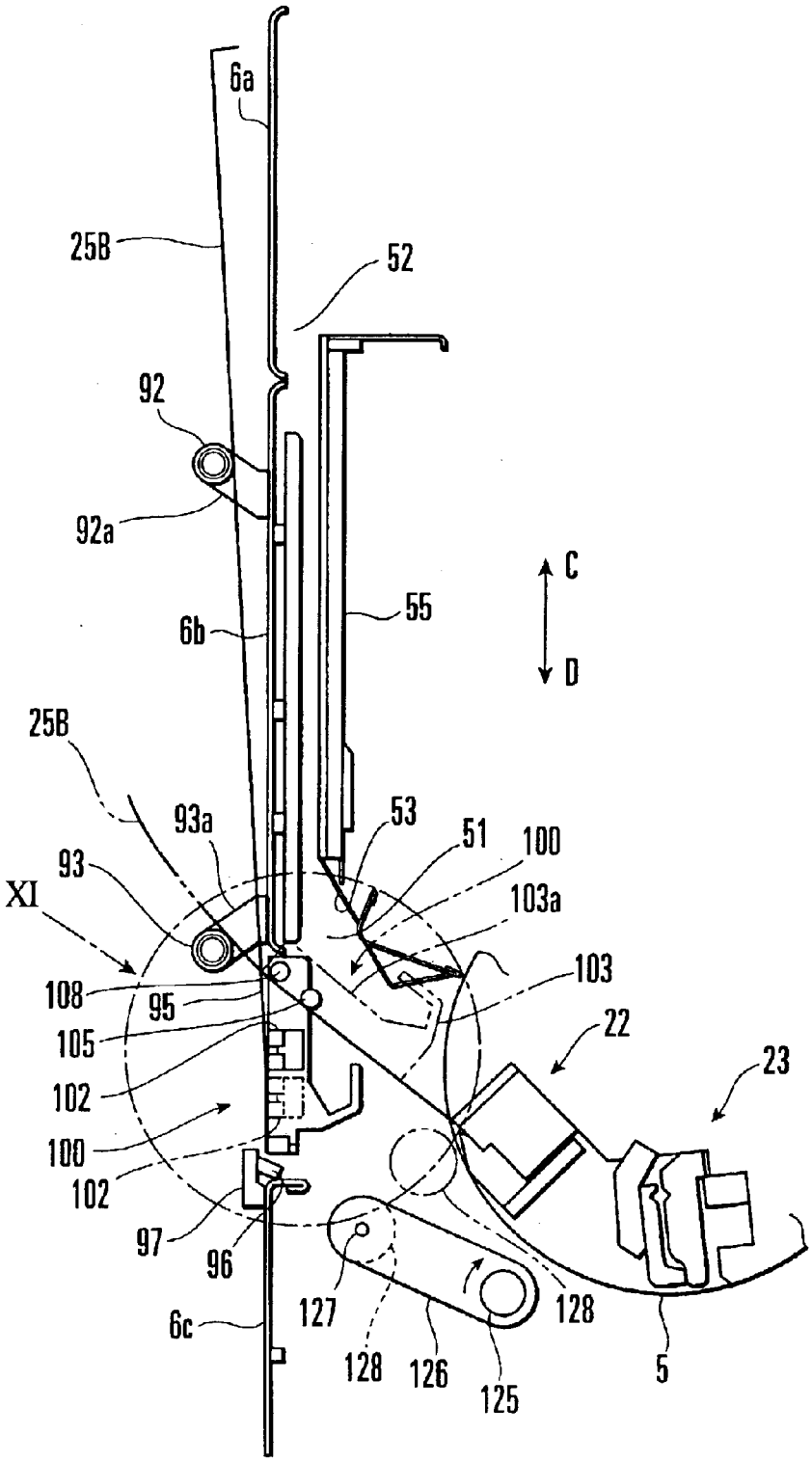
FIG. 10 is a sectional view taken along the line X—X of FIG. 3.

The plate inserting device will be described with reference to FIG. 3 and FIGS. 10 to 13. Referring to FIG. 10, a pair of rod-like guide bars 92 and 93 extend parallel to each other at a predetermined distance from the outer surface of the middle cover 6*b*, such that their axes extend in the widthwise direction of the middle cover 6*b*. The two ends of the guide bar 92 and those of the guide bar 93 are supported at the upper and lower portions of the middle cover 6*b* by support members 92*a* and 93*a*, respectively. A rectangular window 95 extending in the horizontal direction (the direction of the width of the cover) is formed in the upper portion of the lower cover 6*c*. At positions corresponding to the lower end of the window 95, a pair of positioning pins 96 are fixed to the lower cover 6*c* through a support plate 97. Before mounting a new plate 25B on the plate cylinder 5, the positioning notches 26*a* and 26*b* of the new plate 25B are engaged with the positioning pins 96, so that the lower end of the new plate 25B is supported by the positioning pins 96.

Figure 11B:
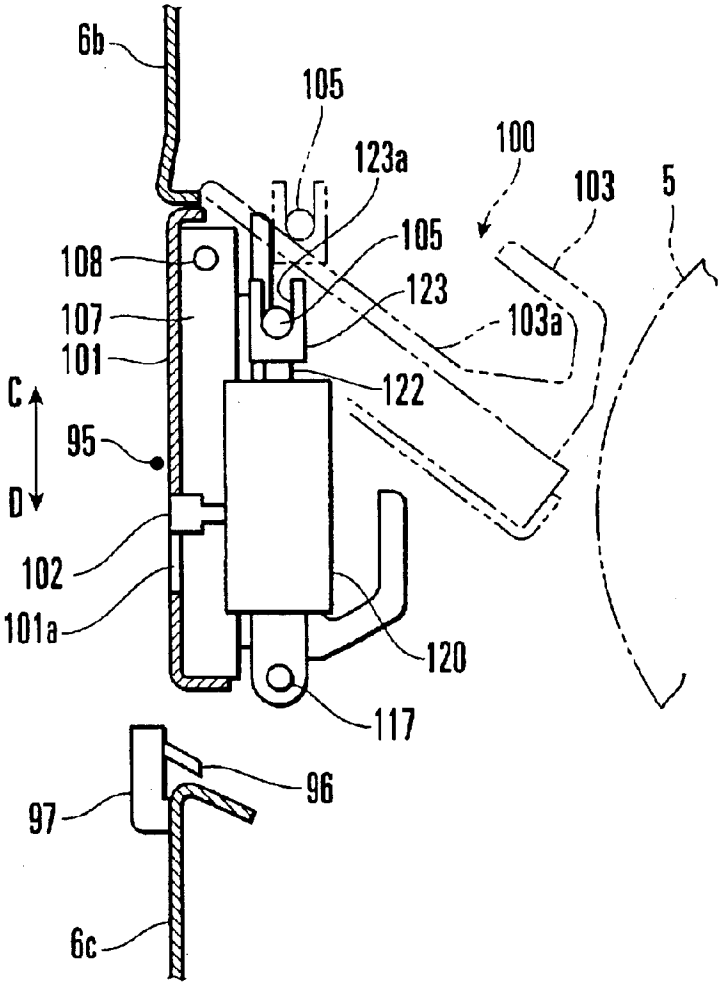
FIG. 11B is a view obtained by adding an air cylinder to FIG. 11A.
Figure 11A:
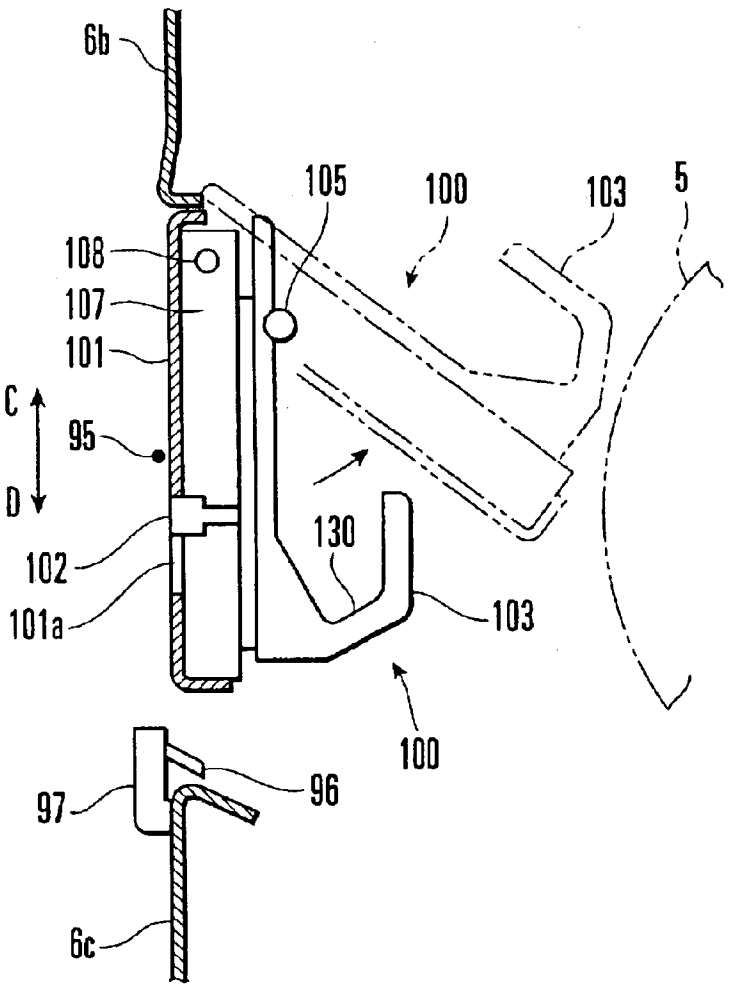
FIG. 11A is an enlarged view of a portion XI of FIG. 10.

As shown in FIG. 11A, the plate feed unit 100 as a swing member is comprised of a swing plate 101 for selectively covering the window 95, a plurality of suction pads 102 for attracting the new plate 25B as an actuating member for the plate handling device, a plate receiving member 103 for receiving the old plate 25A removed from the plate cylinder 5, and a pin 105 for swinging the swing plate 101. The swing plate 101 has an elongated rectangular shape with an outer size slightly smaller than that of the window 95, and a pair of opposing bars 107 are fixed to its two ends in the horizontal direction. The swing plate 101 has a plurality of elongated holes 101*a* in its lower portion, through which the suction pads 102 are exposed.

As the upper portions of the bars 107 are pivotally supported by a pivot shaft 108 standing perpendicularly from the lower cover 6*c*, the swing plate 101 is supported by the middle cover 6*b* to be swingable about the pivot shaft 108 as the pivot center. As shown in FIG. 3, when air cylinders 113 as the actuating members for the plate handling device, which are attached to the lower cover 6*c* are actuated, the suction pads 102 held by a holder 112 move in the elongated holes 101*a* through the holder 112 on the rear side of the swing plate 101 vertically (direction of arrows C–D), that is, in a direction to come close to and separate from the plate cylinder 5. The suction pads 102 are connected to the air tube 13, so that suction air is supplied to them from the suction pump 11.

Figure 12:
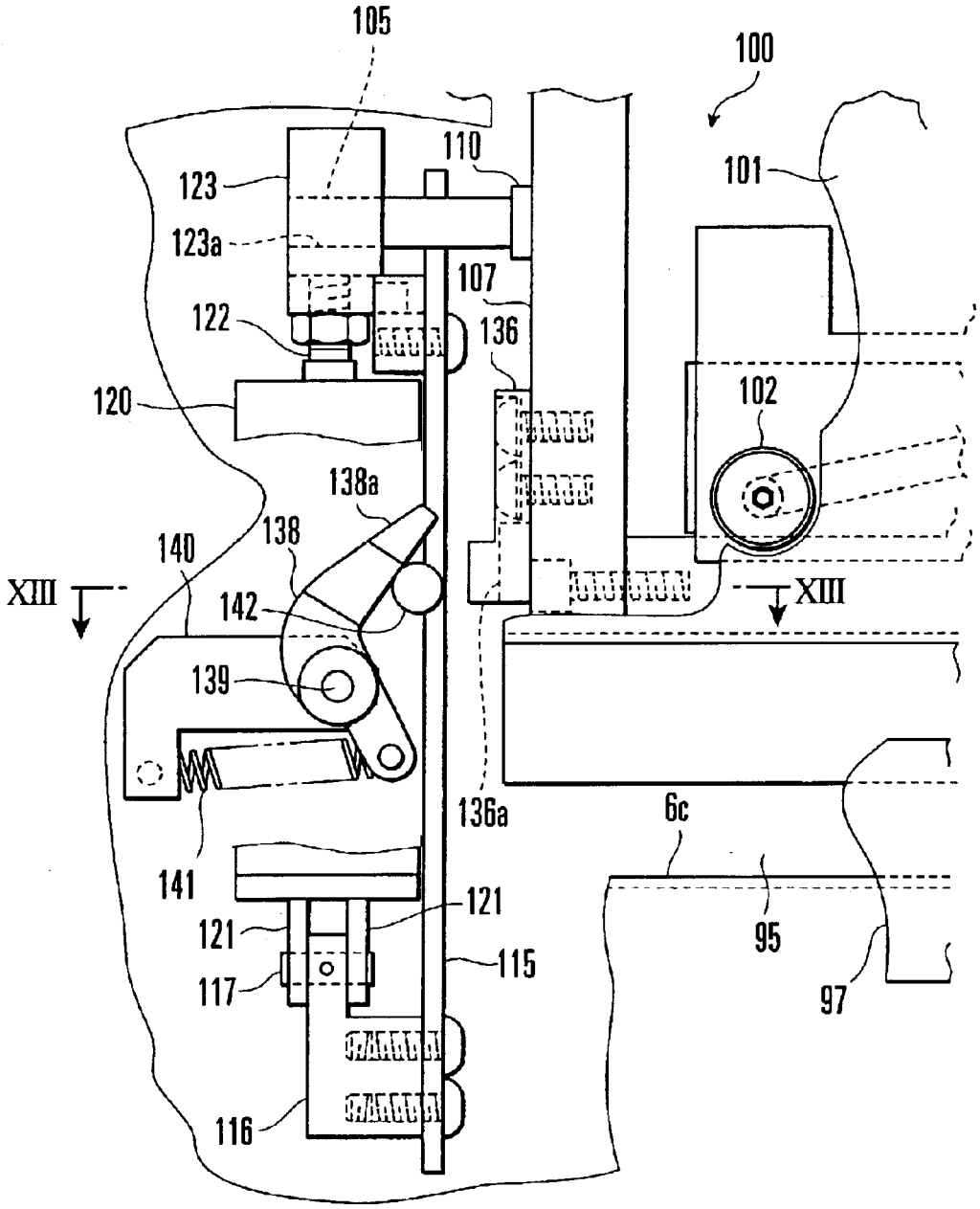
FIG. 12 is an enlarged view of a portion XII of FIG. 3.

As shown in FIG. 11A, the plate receiving member 103 having an L-shaped section is fixed to the rear side of the swing plate 101 through the bars 107, and has a plate receiving portion 103*a* with an upper opening. As shown in FIGS. 11B and 12, the pin 105 is fixed to the bar 107 through a support plate 110, and projects from the side portion of the plate feed unit 100.

The air cylinder that swings the plate feed unit 100 will be described with reference to FIGS. 10, 11B, and 12. As shown in FIG. 12, a support plate 115 is fixed to the frame 31 of the printing unit through a bracket or the like, and a small shaft 117 is axially supported by a stationary element 116 attached to the support plate 115 such that its two ends are exposed. An air cylinder 120 for swinging the plate feed unit 100 is pivotally supported by the small shaft 117 through a pair of opposing hinge 121 projecting downward from it. An engaging member 123 is attached to the distal end of a rod 122 of the air cylinder 120, and a U-groove 123*a* serving as the first groove to engage with the pin 105 is formed in the upper end of the engaging member 123. The pin 105 and U-groove 123*a* form an engaging/disengaging means.

In this arrangement, as indicated by a solid line in FIG. 11B, when the rod 122 of the air cylinder 120 moves backward, the plate feed unit 100, in which the pin 105 engages with the U-groove 123*a* of the engaging member 123, covers the window 95, that is, the plate feed unit 100 is located at a wait position away from the plate cylinder 5. As indicated by an alternate long and two short dashed line, when the rod 122 of the air cylinder 120 moves forward, the plate feed unit 100 pivots counterclockwise about the pivot shaft 108 as the pivot center through the pin 105 engaging with the U-groove 123*a* of the engaging member 123. Hence, the lower end of the plate feed unit 100 is located at the operative position close to the plate cylinder 5, and as shown in FIG. 10, the plate receiving portion 103*a* of the plate receiving member 103 moves toward the insertion port 51.

Press rollers 128 for inserting the trailing edge of the new plate into the plate cylinder will be described with reference to FIG. 10. A driving shaft 125 rotatably supported between the pair of frames 31 is pivoted by a lever and actuator (not shown). One end of each of a pair of opposing support arms 126 (one support arm 126 is not shown) is fixed to a corresponding one of the two ends of the driving shaft 125, and a shaft 127 extends horizontally between the two other-end portions of the support arms 126. The plurality of press rollers 128 are arranged in the axial direction to be parallel to the shaft 127. In this arrangement, when the driving shaft 125 pivots clockwise in FIG. 10, the press rollers 128 come into contact opposite to the outer surface of the plate cylinder 5.

Figure 13:
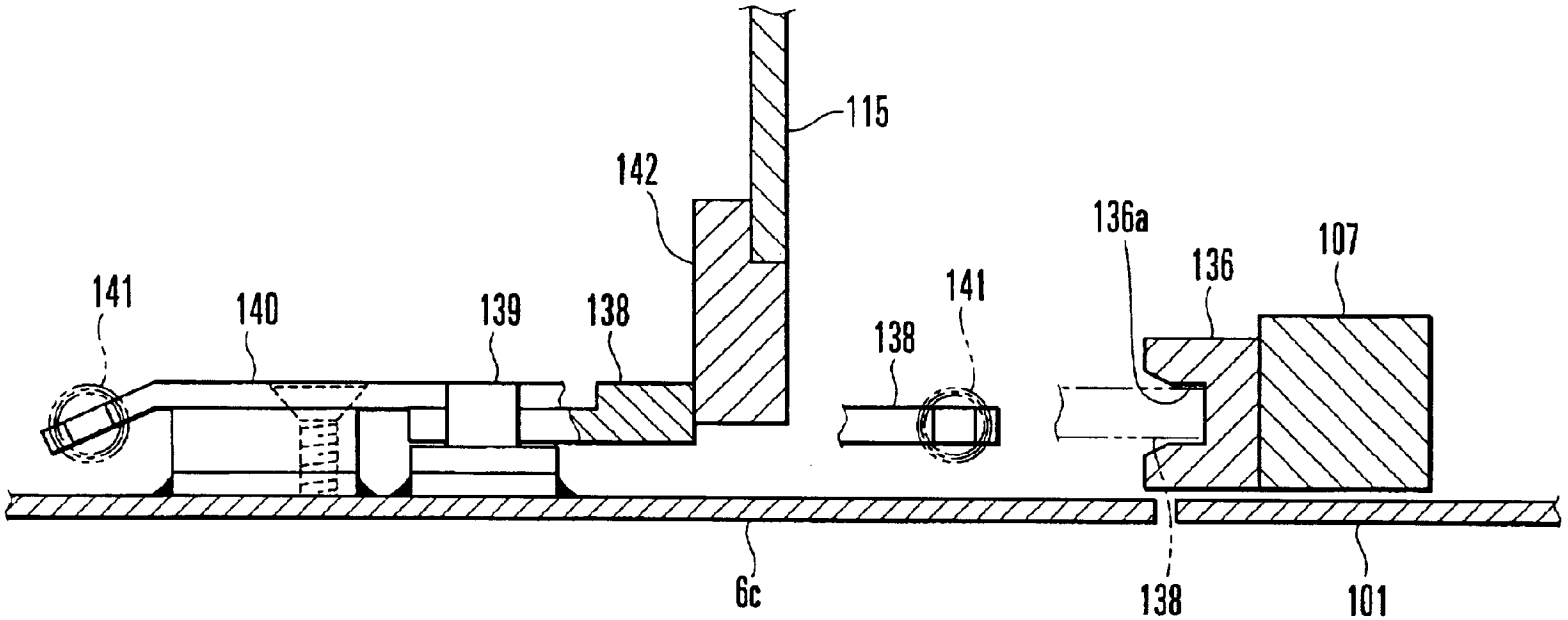
FIG. 13 is a sectional view taken along the line XIII—XIII of FIG. 12.

A structure that regulates swing and cancels swing regulation of the plate feed unit 100 will be described with reference to FIGS. 12 and 13. As shown in FIG. 13, a swing regulating member 136 having an engaging groove 136*a* as the second groove is fixed to the bar 107 of the plate feed unit 100. As shown in FIG. 12, an engaging lever 138 having a V shape when seen from the front is rotatably supported by a small shaft 139 standing perpendicularly from the lower cover 6*c*, and has an engaging portion 138*a*, at its one end, to engage with the engaging groove 136*a* of the swing regulating member 136. The tensile force of a tensile coil spring 141 extending and caught between a spring catching member 140 fixed to the lower cover 6*c* and the other end of the engaging lever 138 biases the engaging lever 138 clockwise in FIG. 12 about the small shaft 139 as the pivot center.

A locking pin 142 fixed to the support plate 115 is provided between the engaging portion 138*a* of the engaging lever 138 and the engaging groove 136*a* of the swing regulating member 136. The engaging lever 138 and the engaging groove 136*a* which engages with it form a swing regulating means that regulates swing of the plate feed unit 100 when the safety cover 6 is moved upward. The engaging lever 138 and the locking pin 142 which locks it form a swing regulation canceling means that cancels swing regulation of the plate feed unit 100 when the safety cover 6 is moved downward.

In this arrangement, when the safety cover 6 moves downward to cover the front portion of the plate cylinder 5, the engaging lever 138 is locked by the locking pin 142, and pivots counterclockwise in FIG. 12 about the small shaft 139 as the pivot center against the tensile force of the tensile coil spring 141. The engaging portion 138*a* separates from the engaging groove 136*a* of the swing regulating member 136 and no longer engages with it, so that the plate feed unit 100 can swing about the pivot shaft 108 as the swing center.

When the safety cover 6 moves upward to open the front portion of the plate cylinder 5, with the locking pin 142 being fixed, the engaging lever 138 and plate feed unit 100 move upward together with the lower cover 6*c*, so that the engaging portion 138*a* of the engaging lever 138 disengages from the locking pin 142. Hence, the engaging lever 138 pivots clockwise in FIG. 12 about the small shaft 139 as the pivot center by the tensile force of the tensile coil spring 141. The engaging portion 138*a* thus engages with the engaging groove 136*a* of the swing regulating member 136, and the plate feed unit 100 is accordingly regulated from swinging about the pivot shaft 108 as the swing center.

Figure 14:
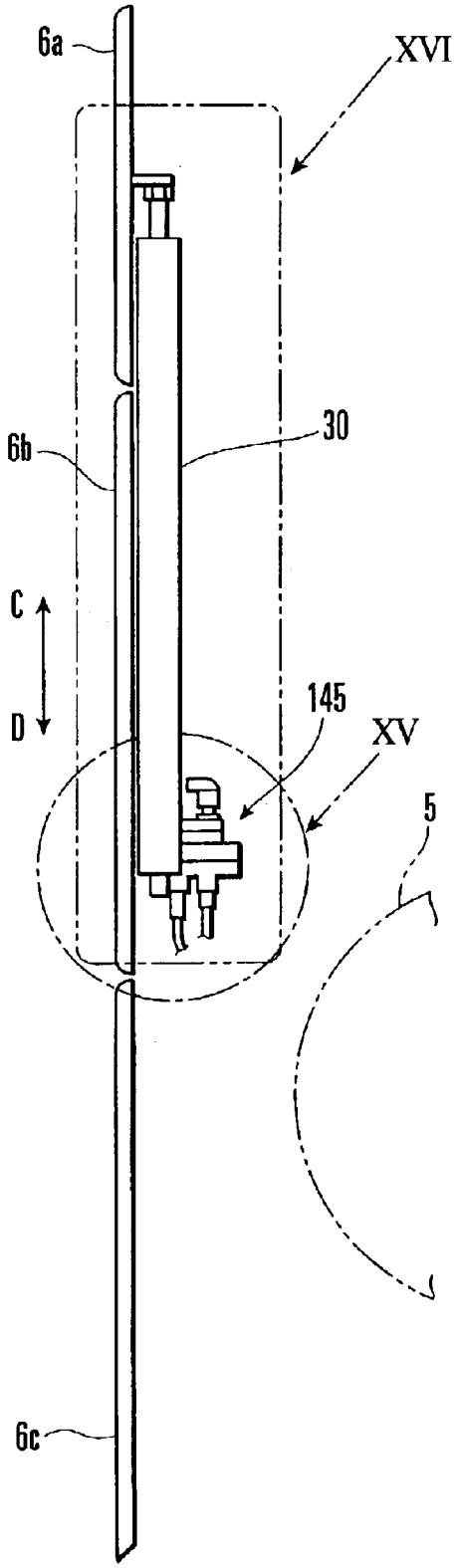
FIG. 14 is a sectional view taken along the line XIIII—XIIII of FIG. 3.
Figure 15:
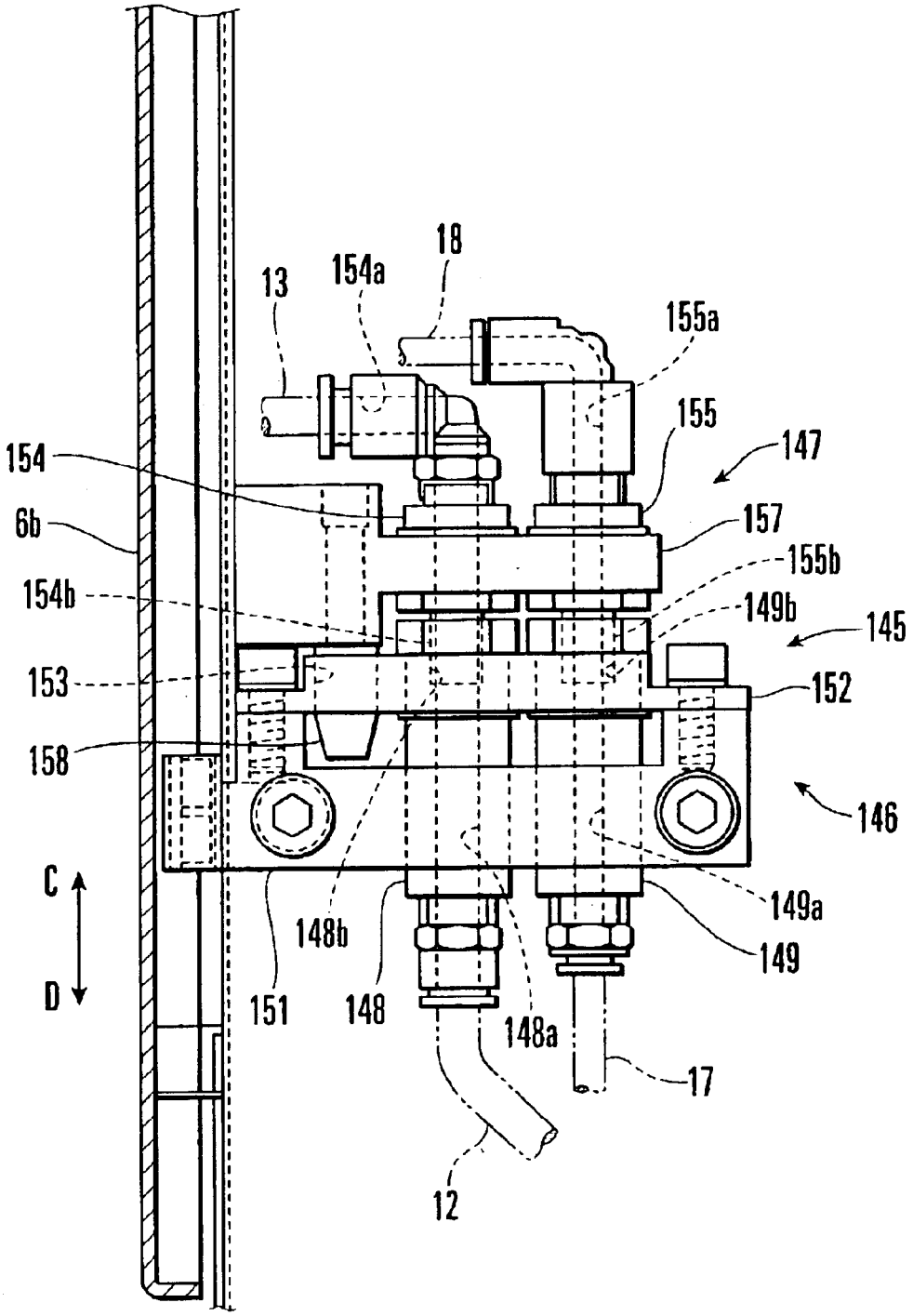
FIG. 15 is an enlarged view of a portion XV of FIG. 14.

A disconnecting/connecting device which disconnects and connects supply of suction air from the suction pump 11 and discharge air from the discharge pump 16 will be described with reference to FIGS. 14 to 16. Referring to FIG. 15, a disconnecting/connecting device 145 for blocking or allowing air flow is comprised of a socket-side unit 146 as the first connecting member, and a plug-side unit 147 as a second connecting member. The socket-side unit 146 has two sockets 148 and 149. The sockets 148 and 149 have passages 148*a* and 149*a* extending through them and valve bodies (not shown) in them.

The upper ends of the sockets 148 and 149 have recesses 148*b* and 149*b* serving as the first connecting portions communicating with the passages 148*a* and 149*a*. The lower end of the socket 148 is connected to the air tube 12 communicating with the passage 148*a*, and the lower end of the socket 149 is connected to the air tube 17 communicating with the passage 149*a*.

The two sockets 148 and 149 are held by a holder 151 side by side, and are fixed to it by a fixing member 152 fastened to it with screws. The holder 151 is fixed to the frame 31 through a bracket (not shown). The fixing member 152 has a positioning hole 153 in which a positioning pin 158 engages before projections 154*b* and 155*b* of plugs 154 and 155 are fitted in the recesses 148*b* and 149*b*.

The plug-side unit 147 has the two plugs 154 and 155. The plugs 154 and 155 have passages 154*a* and 155*a* extending through them and valve bodies (not shown) therein. The plugs 154 and 155 have, at their lower ends, the projections 154*b* and 155*b* serving as second connecting portions communicating with the passages 154*a* and 155*a*. The upper end of the plug 154 is connected to the air tube 13 communicating with the passage 154*a*, and the upper end of the plug 155 is connected to the air tube 18 communicating with the passage 155*a*. The two plugs 154 and 155 are fixed by a holder 157 side by side, and the holder 157 is fixed to the lower portion inside the middle cover 6*b*. The plug-side unit 147 moves as the middle cover 6*b* moves vertically. The holder 157 has the positioning pin 158 which projects downward.

In this arrangement, when the safety cover 6 is moved upward by the air cylinder 30, the middle cover 6*b* also moves upward. As the middle cover 6*b* moves, the plug-side unit 147 also moves upward, while the socket-side unit 146 is kept fixed, as shown in FIG. 16. Therefore, the projections 154*b* and 155*b* of the plugs 154 and 155 disengage from the recesses 148*b* and 149*b* of the sockets 148 and 149, and accordingly air supply from the air tubes 12 and 17 to the air tubes 13 and 18 is stopped. At this time, automatic opening/closing valves (not shown) provided to the sockets 148 and 149 and plugs 154 and 155 automatically close the passages 148*a* and 149*a*, and 154*a* and 155*a*, and outflow of air from the passages 148*a* and 149*a*, and 154*a* and 155*a* is regulated.

Figure 16:
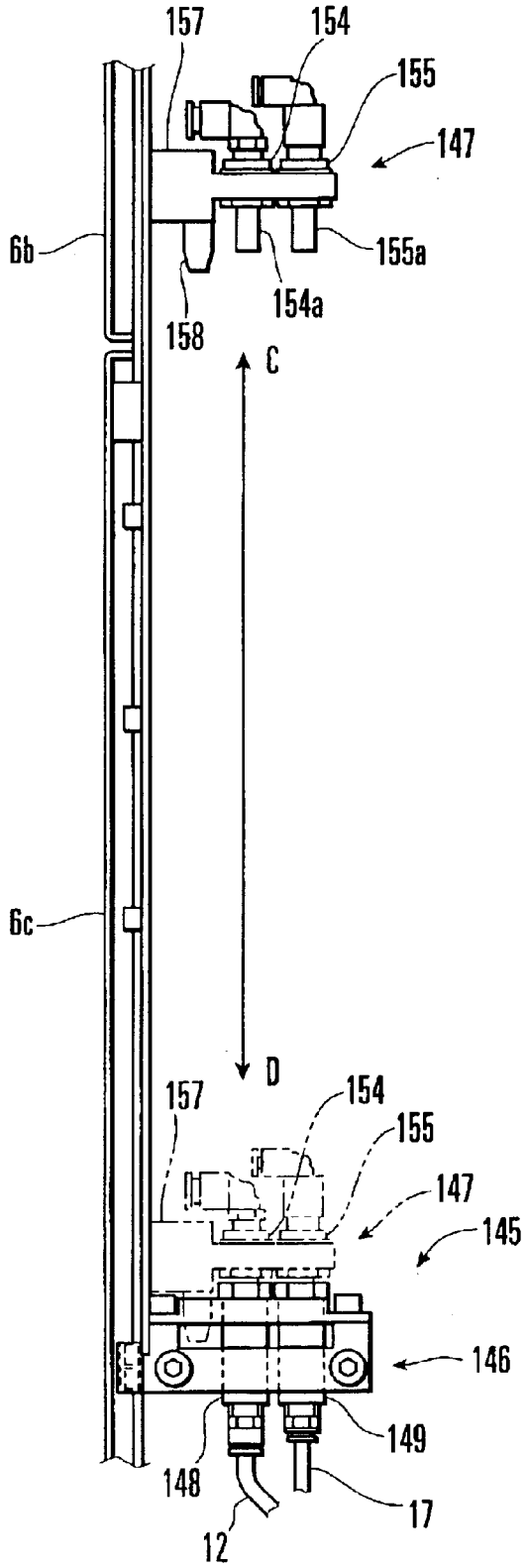
FIG. 16 is an enlarged view of a portion XVI of FIG. 14.

In the state of FIG. 16, when the safety cover 6 is moved by the air cylinder 30 downward, the plug-side unit 147 also moves downward together with the middle cover 6*b*, and the plug-side unit 147 comes close to the socket-side unit 146. At this time, first, the positioning pin 158 of the plug-side unit 147 engages in the positioning hole 153 of the socket-side unit 146. Subsequently, the plug-side unit 147 moves further downward, so that the projections 154*b* and 155*b* of the plugs 154 and 155 fit in the recesses 148*b* and 149*b* of the sockets 148 and 149 smoothly and reliably.

An air supply switching device for supplying air to the air cylinder 30 that vertically moves the safety cover 6 will be described with reference to FIGS. 17A to 17D. FIGS. 17A to 17D show only elements that are necessary for explaining this device.

The solenoid valve 160 for driving the air cylinder 30 has the three ports A, B, and P. The port A is connected through an air tube 161 to that side of the air cylinder 30 which moves the safety cover 6 upward, that is, to an end-side port 30A. The port B is connected through an air tube 162 to that side of the air cylinder 30 which moves the safety cover 6 downward, that is, to a rod-side port 30B. The port P of the solenoid valve 160 is connected to the port P of the solenoid valve 163.

The air cylinder driving solenoid valve 160 is a solenoid valve that performs switching between a mode where the port A is connected to the port P and the port B is opened to the atmospheric pressure, and a mode where the port B is connected to the port P and the port A is opened to the atmospheric pressure. The switching solenoid valve 163 has the three ports P, $P_1$, and $P_2$. The port $P_1$ is connected to a regulator 166 through an air tube 164, and the port $P_2$ is connected to a regulator 167 through an air tube 165. The switching solenoid valve 163 is a switching valve that performs switching between a mode where the port $P_1$ is connected to the port P and the port $P_2$ is closed, and a mode where the port $P_1$ is closed and the ports $P_2$ and P are connected to each other.

The regulator 166 for pressure adjustment is a reducing valve that sets discharge air from a pump 168 to a high pressure and supplies it to the port $P_1$ of the switching solenoid valve 163. The regulator 167 is a reducing valve that is connected to the discharge side of the regulator 166, sets the pressure from the regulator 166 to a relative low pressure, and supplies it to the port $P_2$ of the switching solenoid valve 163. More specifically, the pressure of the discharge air passing through the regulator 166 is set to be larger than a force that pushes up the safety cover 6 against its weight. The pressure of the discharge air passing through the regulator 167 is set to be smaller than the force that pushes up the safety cover 6 against its weight.

Figure 18:
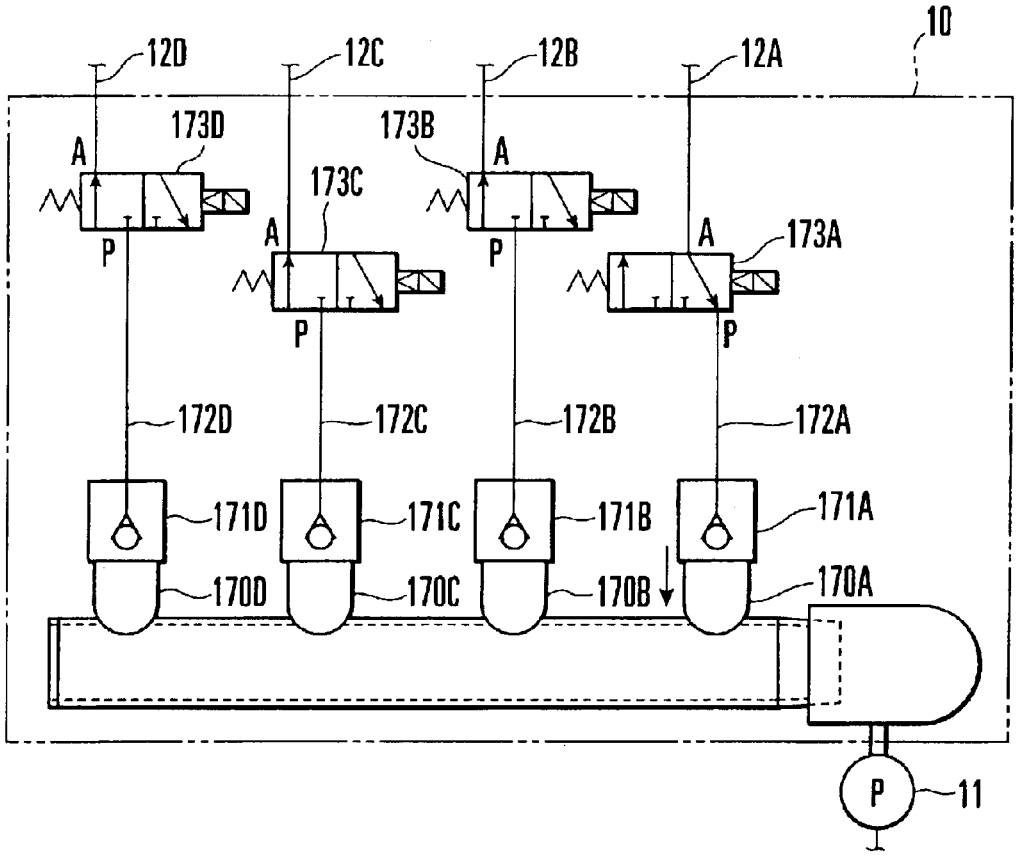
FIG. 18 is a view showing the arrangement of the cylinder controller for the plate supply unit shown in FIG. 1.

The cylinder controller 10 for the plate feed unit 100 will be described with reference to FIG. 18. One end of each of four pipes 170A to 170D is commonly connected to the suction pump 11. The other end of each of the pipes 170A to 170D is connected to a corresponding one of check valves 171A to 171D. The check valves 171A to 171D are connected to air flow channel switching solenoid valves 173A to 173D through air tubes 172A to 172D, respectively. The air flow channel switching solenoid valves 173A to 173D each having two ports P and A are solenoid valves that perform switching between a mode where the port A is opened to the atmosphere and the port P is closed, and a mode where the port A is connected to the port P. The port A is connected to the air tube 12.

The disconnecting/connecting devices 145A to 145D are connected to the plurality of suction pads 102 of the plate feed units 100, provided to the safety covers 6A to 6D, through the air tubes 13A to 13D, respectively. When an air flow channel switching solenoid valve 173 is inoperative and its port A is open to the atmosphere, the interiors of the air tubes 12 and 13 become atmospheric pressure, and supply of suction air from the suction pump 11 to the suction pads 102 is stopped. When the air flow channel switching solenoid valve 173 is operative and its port A is connected to the port P, suction air from the suction pump 11 is supplied to the suction pads 102 through the pipes 170, air tubes 172, and the air tubes 12 and 13.

The check valve 171 is normally held in a closed state, and opens when the air flow channel switching solenoid valve 173 actuates to supply suction air from the suction pump 11 to the suction pads 102. The check valve 171 is also open while the suction air continues to be supplied and the interiors of the air tubes 172, 12, and 13 are set in a negative pressure state because the suction pads 102 are attracted to the new plate. While the interiors of the air tubes 172, 12, and 13 are set in the negative pressure state, for example, when some of another suction system is opened to the atmosphere and the suction pressure decreases, the check valve 171 closes. This blocks air passing between the air tube 172 and the pipe 170, to hold the negative pressure state in the air tubes 172, 12, and 13.

Figure 22:
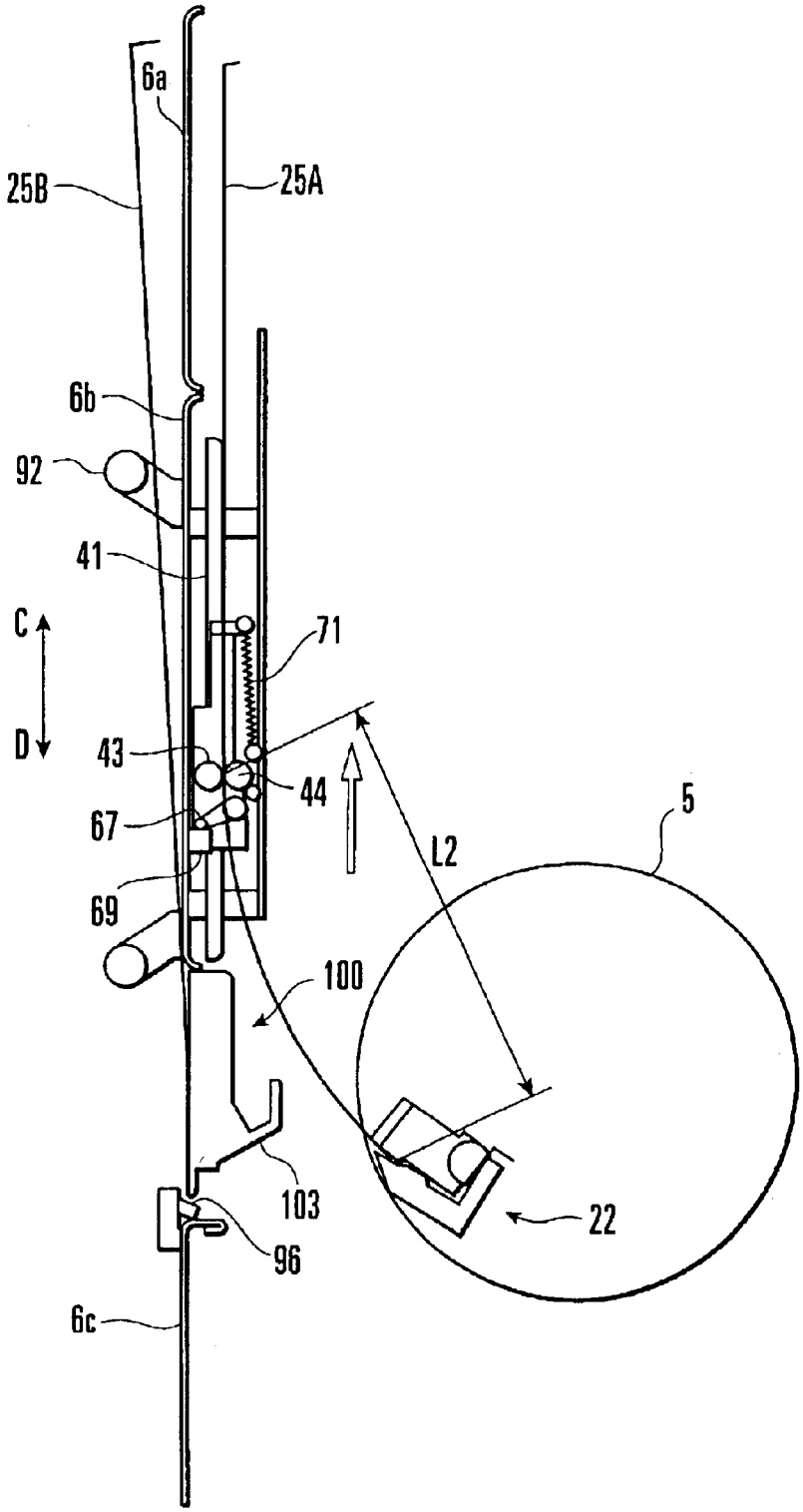
FIG. 22 is a side view of the printing unit showing a state wherein the plate holding apparatus is located at the first position for holding the old plate.
Figure 25:
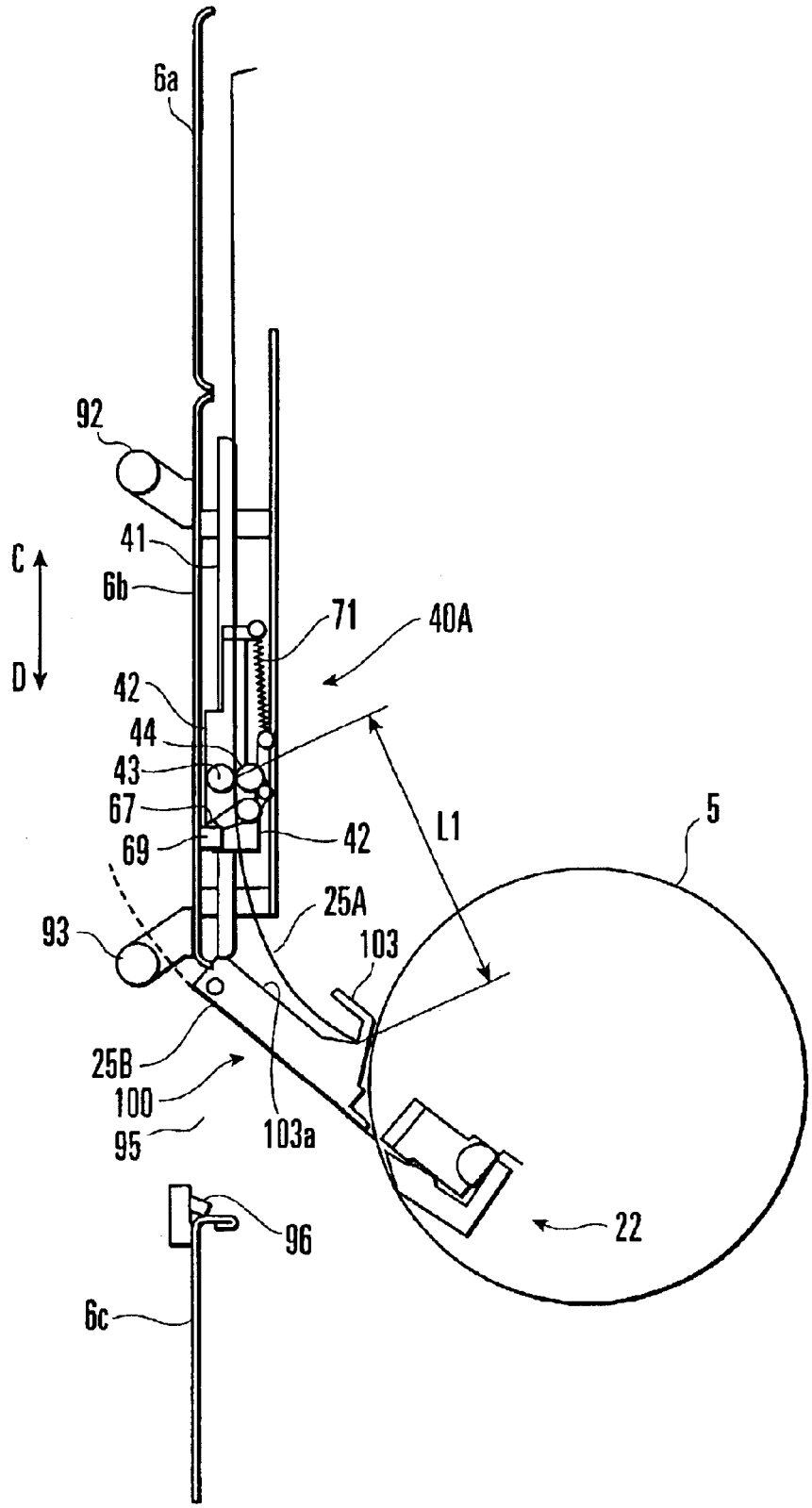
FIG. 25 is a side view of the printing unit showing a state wherein the plate holding apparatus has moved downward while holding the plate.
Figure 26:
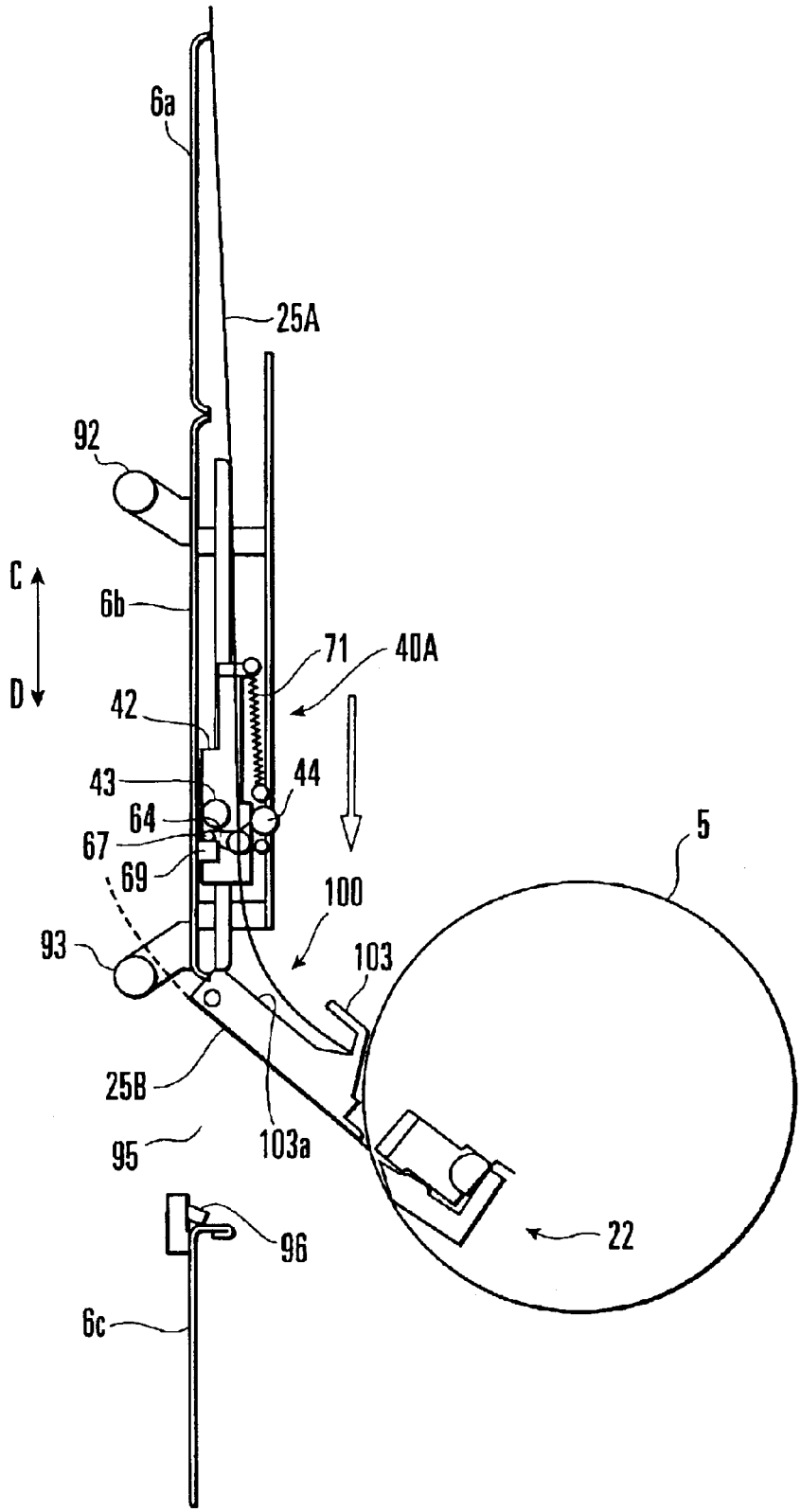
FIG. 26 is a side view of the printing unit showing a state wherein the plate holding apparatus has released the plate.

The relationship between the distance between the support member 42 and plate receiving member 103, when the support member 42 of the plate holding device 40A is positioned at the first position, and the length from the first and second rotary members 43 and 44 to the lower end of the old plate 25A will be described with reference to FIGS. 22 and 25. While the old plate 25A is held by the first and second rotary members 43 and 44, the support member 42 moves upward to the second position. Subsequently, the support member 42 moves downward to be positioned at the first position again, as shown in FIG. 25. At this time, a distance L1 between the first and second rotary members 43 and 44 and the plate receiving portion 103*a* of the plate receiving member 103 is set to be smaller than a length L2 between the first and second rotary members 43 and 44 and the lower end of the old plate 25A, which length L2 being obtained when the support member 42 is positioned at the first position. As the positions of the first and second rotary members 43 and 44 with respect to the distances L1 and L2, the position of a predetermined portion of the support member 42 may be used.

Figure 19:
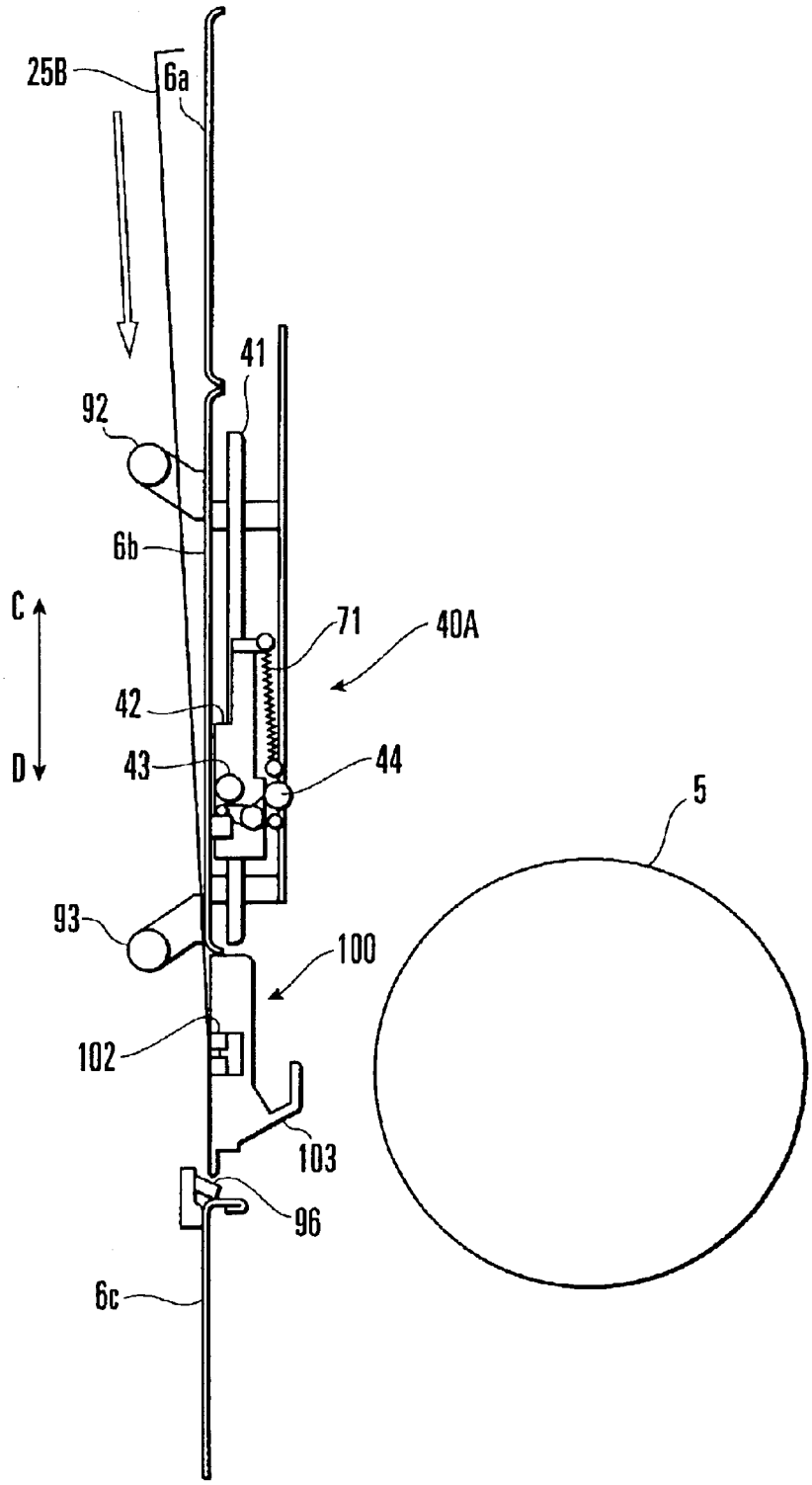
FIG. 19 is a side view of a printing unit showing a state wherein preparation of supplying a new plate is done.

The plate exchange operation of the plate holding apparatus having the above arrangement will be described with reference to FIGS. 19 to 29. As shown in FIG. 19, the upper, middle, and lower covers 6*a*, 6*b*, and 6*c* are located at low positions, and the front portion of the plate cylinder 5 is covered by the middle and lower covers 6*b* and 6*c*. The support member 42 of the plate holding device 40A is located at a low position, and the second rotary member 44 is separate from the first rotary member 43.

In this state, the new plate 25B is set in a wait state. More specifically, the positioning notches 26*a* and 26*b* in the leading edge (lower end in FIG. 19) of the new plate 25B are engaged with the positioning pins 96, so the lower end of the new plate 25B is supported by the positioning pins 96. Subsequently, the upper portion of the new plate 25B is brought into contact with the guide bar 92, and the lower end of the new plate 25B is attracted by the suction pads 102 of the plate feed unit 100. This plate mounting operation is performed by the first-color printing unit 3A of the four printing units 3A to 3D (FIG. 1).

At this time, in the first-color printing unit 3A, the air flow channel switching solenoid valve 173A (FIG. 18) is switched from the mode where the port A is connected to the air tube 12A to the mode where the port B is to be connected to the air tube 12A. In other printing units 3B to 3D, the air flow channel switching solenoid valves 173B to 173D stay in the mode where the air tube 12A is connected to the port A. Hence, suction air supplied from the suction pump 11 is supplied to the suction pads 102 of the first-color printing unit 3A through the pipe 170A and air tubes 172A, 12A, and 13A. The suction air is not supplied to the suction pads 102 of other printing units 3B to 3D.

When the new plate 25B is attracted by the suction pads 102 of the first-color printing unit 3A and suction air is supplied from the suction pump 11, the interiors of the air tube 172A, 12A, and 13A are set in the negative pressure state. In this state, the air flow channel switching solenoid valve 173B of the second-color printing unit 3B is switched from the mode where the air tube 12B is connected to the port A to the mode where the air tube 12B is to be connected to the port B. Thus, suction air from the suction pump 11 is supplied to the suction pads 102 of the second-color printing unit 3B through the pipe 170B and air tubes 172B, 12B, and 13B.

At this time, before the new plate 25B is attracted by the suction pads 102 of the second-color printing unit 3B, the interior of the air tube 13B temporarily becomes atmospheric pressure, although for a short period of time, and the suction pressure of the suction pump 11 decreases temporarily. As the interiors of the air tubes 172A, 12A, and 13A for the first color are set in the negative pressure state, when the suction pressure of the suction pump 11 decreases, the check valve 171A closes, as described above. Therefore, air passage between the air tube 172A and pipe 170A is blocked by the check valve 171A, so that the negative pressure state in the air tubes 172A, 12A, and 13A is held.

For this reason, the new plate 25B attracted by the suction pads 102 of the first-color printing unit 3A does not separate from the suction pads 102 or cause a positional shift. In the same manner, the new plates 25B are sequentially set in the wait state where they are attracted by the suction pads 102 of the third- and fourth-color printing units 3C and 3D. As air can be supplied to the suction pads 102 of the plurality of printing units 3A to 3D with one suction pump 11, the manufacturing cost can be reduced, and the device can be downsized.

In each of the printing units 3A to 3D, the old plate 25A the lower end of which is attracted by the suction pads 102 is supported by the suction pads 102 and guide bar 92 substantially linearly along the upper, middle, and lower covers 6*a*, 6*b*, and 6*c*.

Figure 20:
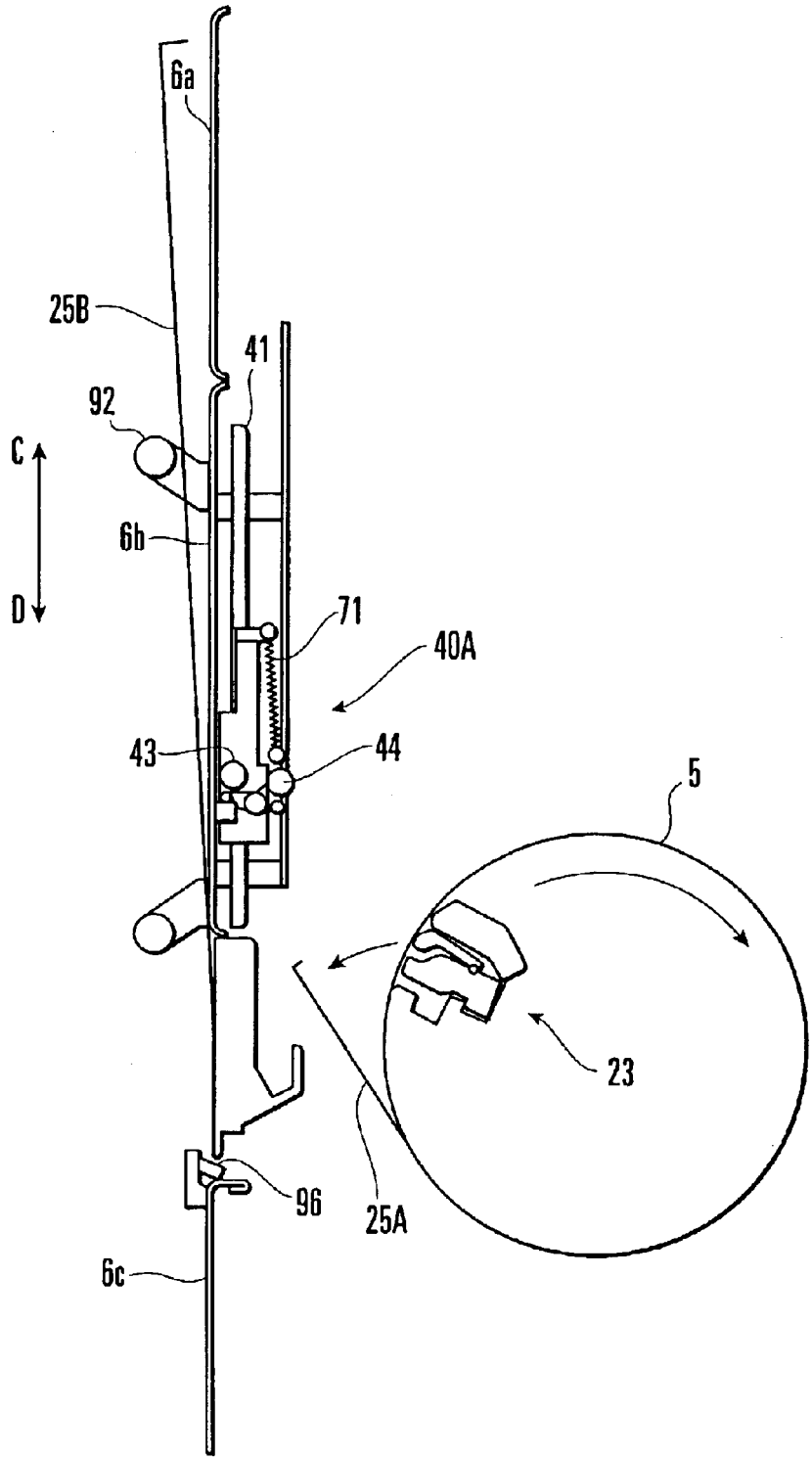
FIG. 20 is a side view of a printing unit showing a state wherein an old plate is removed from the trailing edge plate clamp device of a plate cylinder.
Figure 21:
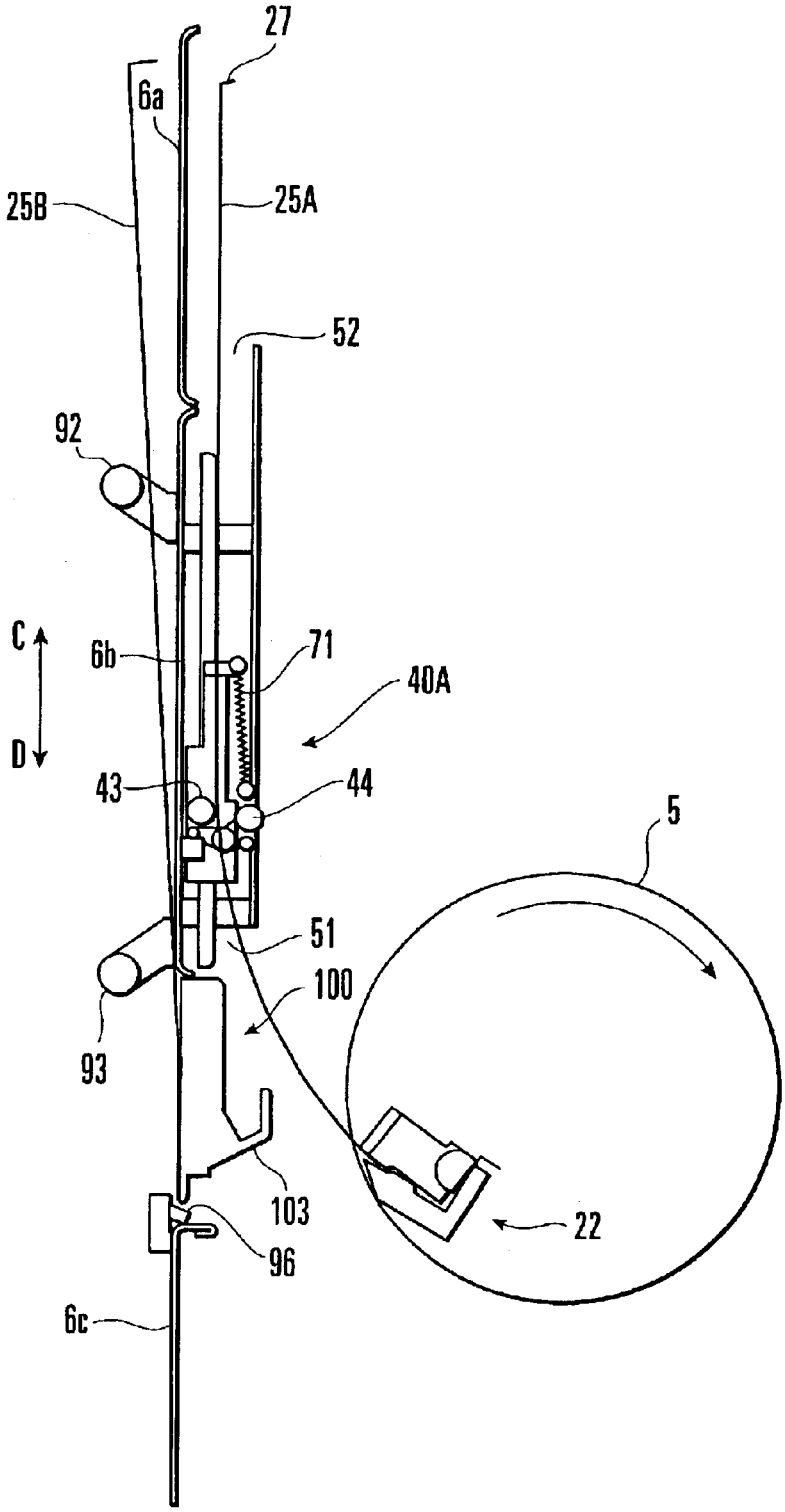
FIG. 21 is a side view of the printing unit showing a state wherein the old plate is introduced into the plate holding apparatus.

Then, the old plate 25A is discharged. More specifically, as shown in FIG. 20, the plate cylinder 5 is released from the trailing edge plate clamp device 23, and from the leading edge plate clamp device 22 as well. Hence, the bent portion 27 as the trailing edge of the old plate 25A mounted on the plate cylinder 5 separates from the plate cylinder 5. In this state, the plate cylinder 5 is rotated clockwise in FIG. 20 through almost one turn and stopped, so the leading edge plate clamp device 22 opposes the plate feed unit 100. At this time, as shown in FIG. 21, the bent portion 27 (distal end) of the old plate 25A enters the plate holding device 40A from the insertion port 51, then passes through a portion between the first and second rotary members 43 and 44, and projects from the discharge port 52.

When this state is detected, discharge air from the discharge pump 16 is supplied by the cylinder controller 15 for the plate holding device to the air cylinder 41 of the plate holding device 40A through the air tube 17, disconnecting/connecting device 145, and air tube 18. The air cylinder 41 is thus driven to move the support member 42 upward from the wait position, and the roller 67 of the lever 64 separates from the stopper 69, as shown in FIG. 22. Hence, the tensile force of the tensile coil spring 71 pivots the lever 64 to bias and press the second rotary member 44 against the first rotary member 43, and the support member 42 is positioned at the first position. At this time, the old plate 25A is held by the first and second rotary members 43 and 44.

Figure 23:
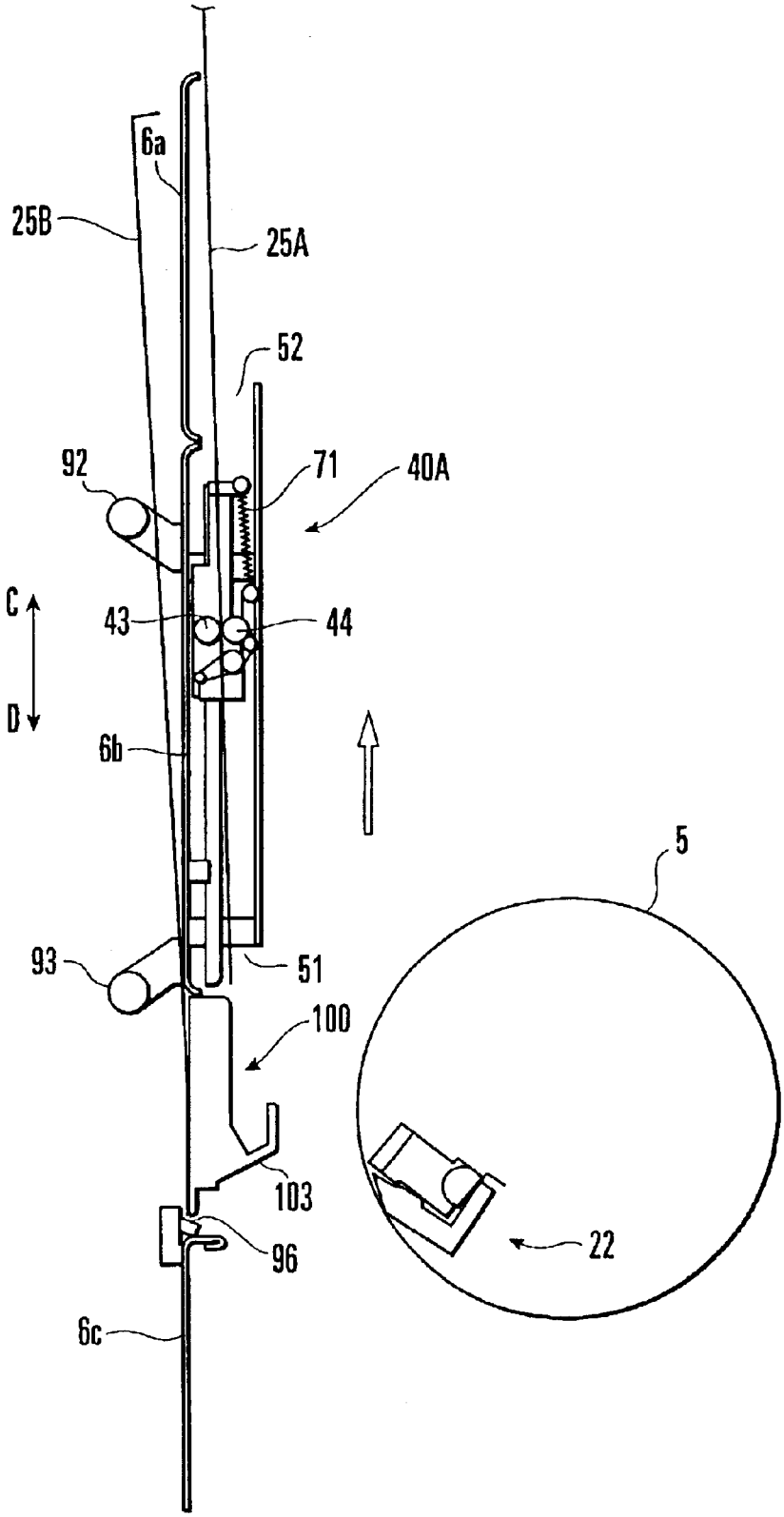
FIG. 23 is a side view of the printing unit showing a state wherein the plate holding apparatus removes the old plate from the plate cylinder and positions it at the second position away from the plate cylinder.
Figure 24:
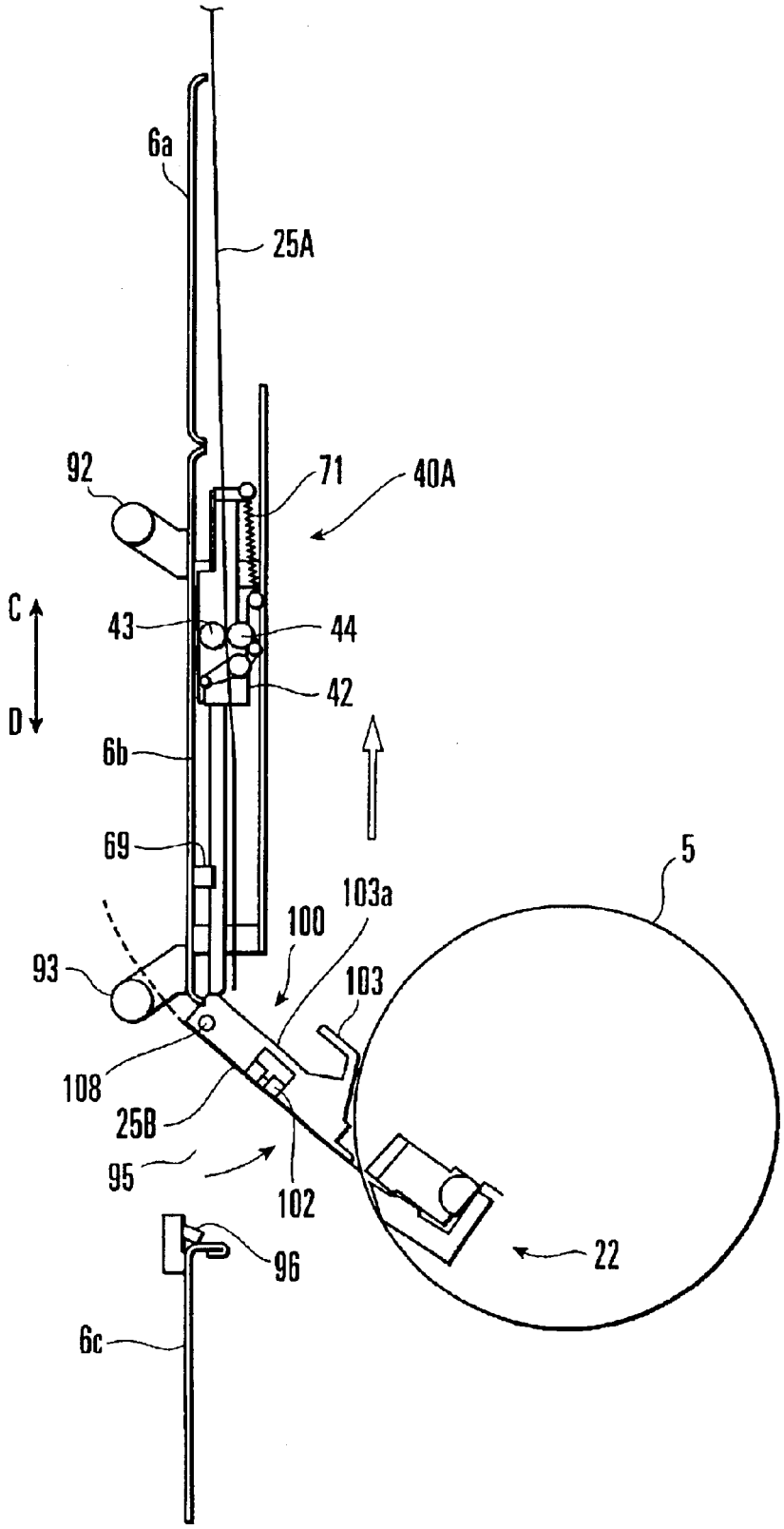
FIG. 24 is a side view of the printing unit showing a state wherein a plate feed unit is close to the plate cylinder.

Subsequently, the air cylinder 41 moves the support member 42 further upward, so the old plate 25A moves upward as it is held by the first and second rotary members 43 and 44. The lower end (leading edge) of the old plate 25A disengages from the leading edge plate clamp device 22 of the plate cylinder 5, and the support member 42 is positioned at the second position as the upper limit, as shown in FIG. 23.

At this time, as the one-way clutches 45 and 46 are mounted on the first and second rotary members 43 and 44, rotations of the first and second rotary members 43 and 44 in the directions to disengage the old plate 25A from the plate cylinder 5 are allowed, and their rotations in directions opposite to the directions to disengage the old plate 25A are regulated. As a result, the old plate 25A is reliably released by the leading edge plate clamp device 22 of the plate cylinder 5. The old plate 25A does not deform to flex before it is disengaged from the leading edge plate clamp device 22, so it is prevented from breaking the plate holding device 40A or entering the ink form roller to damage it.

As the old plate 25A discharged from the plate cylinder 5 is only held and moved by the two rotary members 43 and 44, the structure is simplified. After the trailing edge of the old plate 25A is disengaged from the plate cylinder 5, immediately until the leading edge of the old plate 25A is disengaged, the old plate 25A is introduced into the plate holding device 40A by the rotation of the plate cylinder 5, and the support member 42 is moved upward only when the leading edge of the old plate 25A is to be disengaged. Therefore, the moving amount of the support member 42 can be minimized, and the air cylinder 41 which drives the support member 42 can be downsized.

Subsequently, the air cylinder 120 is driven to move the rod 122 (FIG. 11B) forward, so that the pin 105 engaging with the U-groove 123*a* of the engaging member 123 moves to the position indicated by an alternate long and two short dashed line shown in FIG. 11B. The plate feed unit 100 pivots counterclockwise in FIG. 11B about the pivot shaft 108 as the pivot center, and its lower end comes close to the plate cylinder 5 with the plate receiving portion 103*a* of the plate receiving member 103 facing up. Subsequently, as shown in FIG. 25, the support member 42 is moved downward by the air cylinder 41, and the roller 67 of the lever 64 comes into contact opposite to the stopper 69. At this time, the support member 42 is located at the first position where it should be immediately before the second rotary member 44 separates from the first rotary member 43, and the lower end of the old plate 25A is supported by the plate receiving portion 103*a* of the plate receiving member 103.

The distance L1 (distance between the first and second rotary members 43 and 44 and the plate receiving portion 103*a* of the plate receiving member 103) is set to be smaller than the length L2 (length from the first and second rotary members 43 and 44 to the lower end of the old plate 25A). Thus, before the first and second rotary members 43 and 44 are positioned at the first position, the lower end of the old plate 25A held by rotation of the first and second rotary members 43 and 44 abuts against the plate receiving portion 103*a*. Subsequently, the old plate 25A is kept held by the first and second rotary members 43 and 44 until the support member 42 moves downward to be positioned at the first position.

During this period of time, the lower end of the old plate 25A is urged against the plate receiving portion 103*a*, while the one-way clutches 45 and 46 allow the first and second rotary members 43 and 44 to rotate in the directions to disengage the old plate 25A from the plate cylinder 5. Therefore, the first and second rotary members 43 and 44 rotate while holding the old plate 25A, and the old plate 25A moves upward with its lower end abutting against the plate receiving portion 103*a*. As a result, the old plate 25A can be prevented from being urged against the plate receiving portion 103*a* with a strong force to damage it.

At the first position, when the second rotary member 44 separates from the first rotary member 43 to release the old plate 25A, the lower end of the old plate 25A certainly abuts against the plate receiving portion 103*a* of the plate receiving member 103. When the two rotary members 43 and 44 release the old plate 25A, the old plate 25A does not drop onto the plate receiving portion 103*a* to damage the plate receiving member 103 with its lower end.

Figure 27:
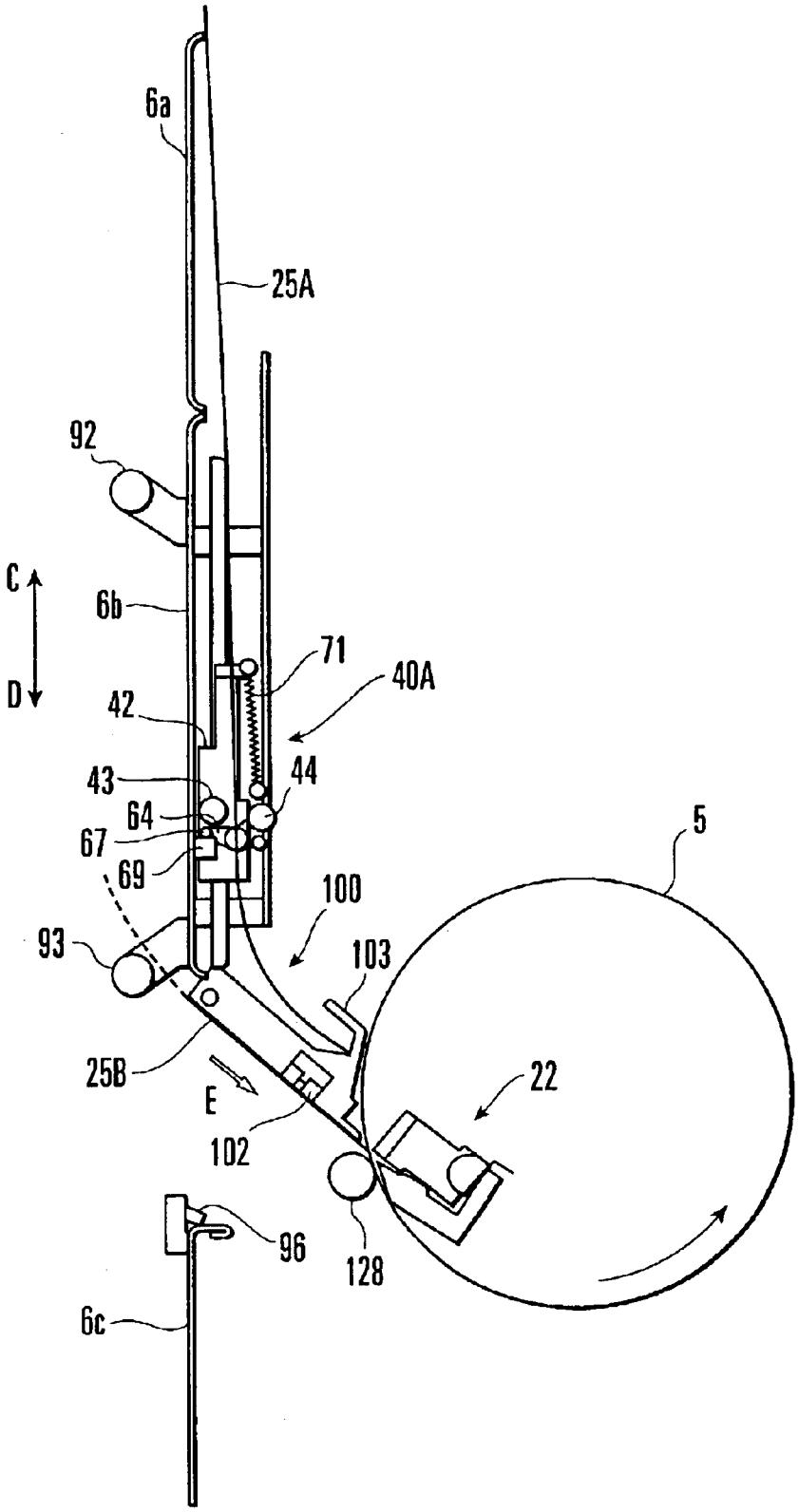
FIG. 27 is a side view of the printing unit showing a state wherein a new plate is inserted from the plate feed unit into the leading edge plate clamp device of the plate cylinder.

The driving shaft 125 (FIG. 10) is pivoted by an actuator (not shown), and accordingly the press roller 128 comes into contact opposite to the outer surface of the plate cylinder 5, as shown in FIG. 27. In this state, when the suction pads 102 are moved by the air cylinder 113 in a direction of arrow E, the lower end (leading edge) of the new plate 25B enters the leading edge plate clamp device 22 of the plate cylinder 5, and is gripped by the leading edge plate clamp device 22.

Subsequently, the air flow channel switching solenoid valves 173A to 173D (FIG. 18) of the printing units 3A to 3D are switched from the mode where the port A is connected to the air tube 12 to the mode where the port B is connected to the air tube 12, and accordingly the air pressure in the air tubes 13A to 13D is switched from the negative pressure to the atmospheric pressure. As a result, the new plate 25B attracted by the suction pads 102 is released.

Figure 28:
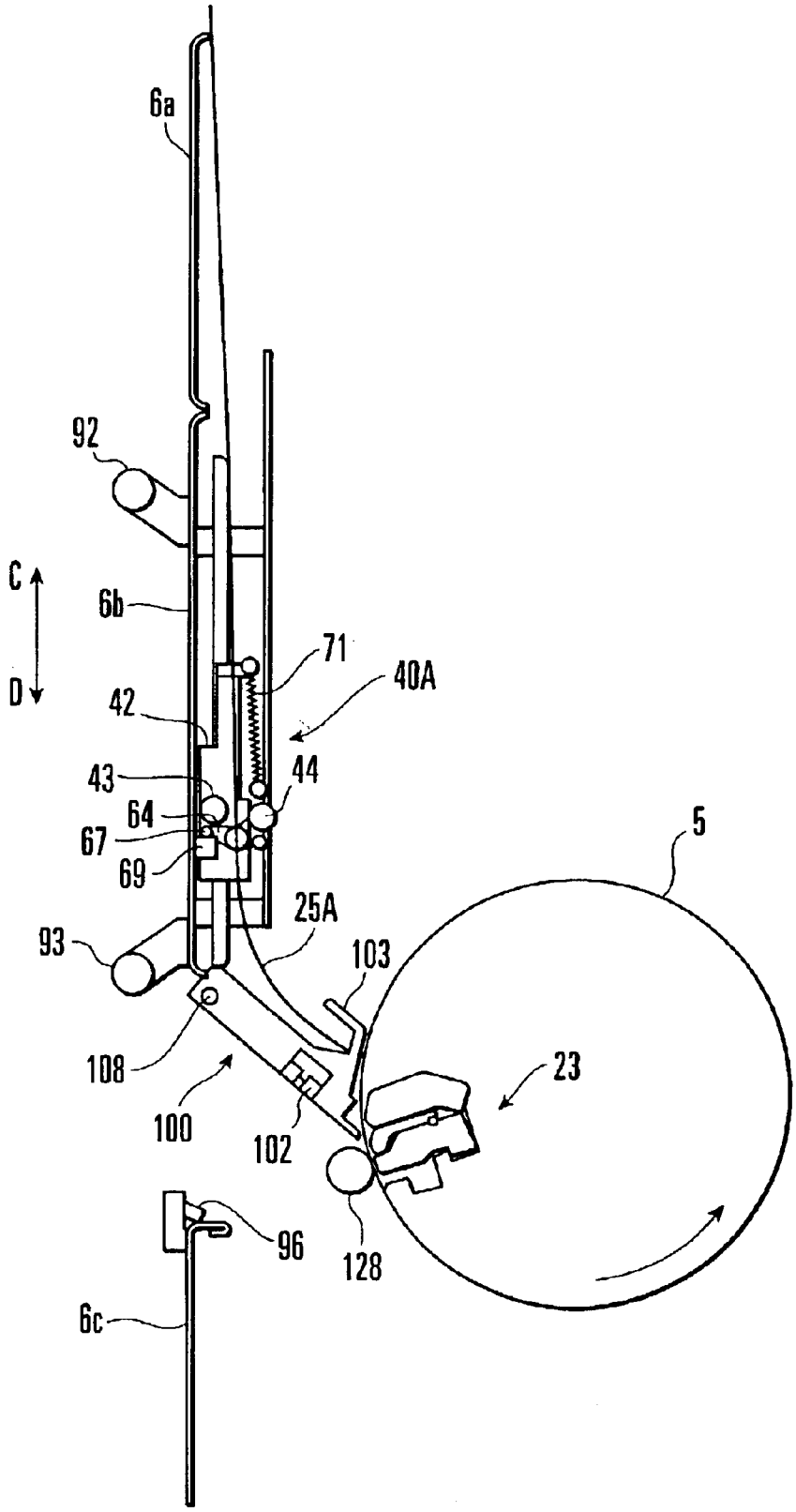
FIG. 28 is a side view of the printing unit showing a state wherein the new plate is mounted on the plate cylinder.
Figure 29:
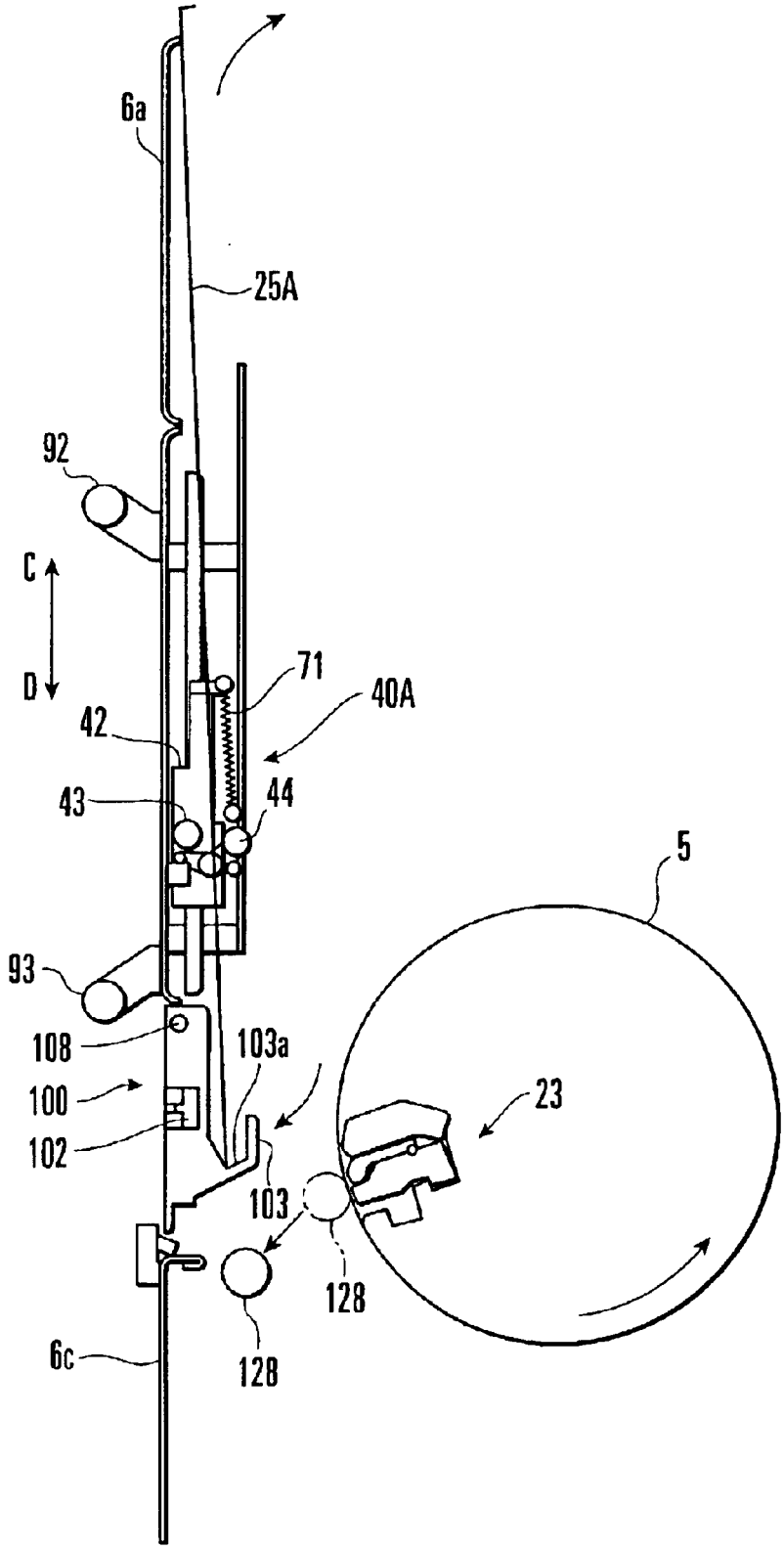
FIG. 29 is a side view of the printing unit showing a state wherein the old plate is being discharged.

Subsequently, as shown in FIG. 28, the plate cylinder 5 pivots counterclockwise, so the new plate 25B is brought into tight contact with the outer surface of the plate cylinder 5 by the press roller 128. Then, the plate cylinder 5 rotates substantially through one turn, so the bent portion 27 as the trailing edge of the new plate 25B is inserted into the trailing edge plate clamp device 23 of the plate cylinder 5 by the press roller 128. As a result, the new plate 25B is gripped by the trailing edge plate clamp device 23 of the plate cylinder 5, and is mounted on the outer surface of the plate cylinder 5.

Subsequently, the rod 122 (FIG. 11B) of the air cylinder 120 is moved backward as indicated a solid line, so the pin 105 engaging with the U-groove 123*a* of the engaging member 123 also moves to the position indicated by a solid line. Hence, the plate feed unit 100 pivots clockwise in FIG. 29 about the pivot shaft 108 as the pivot center, and is positioned at the wait position retreated from the plate cylinder 5 so as to cover the window 95. Finally, the old plate 25A supported by the plate receiving portion 103*a* of the plate receiving member 103 is discharged from an upper portion of the apparatus.

In this manner, since the old plate 25A can be discharged after it is released by the first and second rotary members 43 and 44, the discharging operation can be performed easily within a short period of time. Since the old plate 25A which has been moved upward once by the first and second rotary members 43 and 44 is moved downward and supported by the plate receiving member 103. The height of the upper end of the old plate 25A, the lower end of which is supported by the plate receiving member 103, decreases by an amount corresponding to the dropping amount, improving the discharge workability.

Figure 17A:
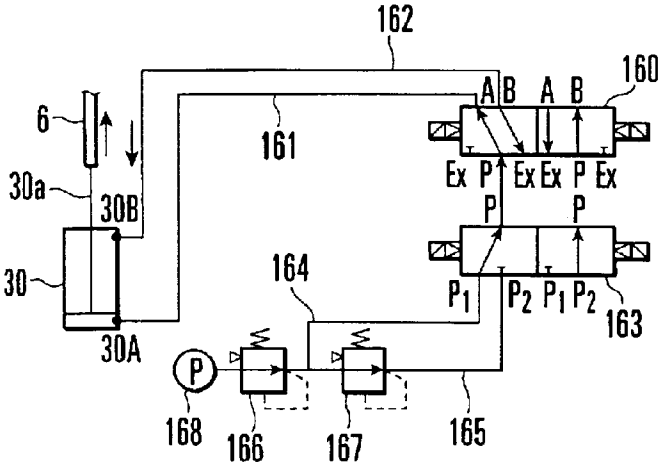
FIG. 17A is a circuit diagram of an air supply device in the state of moving a safety cover upward.

The operation of vertically moving the safety cover 6 for the purpose of cleaning the interior of the device 40 or maintenance and inspection will be described. When moving the safety cover 6 upward, one solenoid of the air cylinder driving solenoid valve 160 is actuated, so the air cylinder driving solenoid valve 160 is switched to the mode where the port P is connected to the port A and the port B is opened to the atmospheric pressure. Also, the other solenoid of the switching solenoid valve 163 is actuated, so the switching solenoid valve 163 is switched to the mode where the port P is connected to the port $P_1$ (FIG. 17A). As described above, the pressure of the discharge air is set to be larger than the force that pushes up the safety cover 6 against its weight. Therefore, when the high-pressure air to be supplied to the port $P_1$ by the regulator 166 is supplied to the end-side port 30A that raises the safety cover 6, the safety cover 6 is moved upward by the rod 30*a* of the air cylinder 30.

Figure 17B:
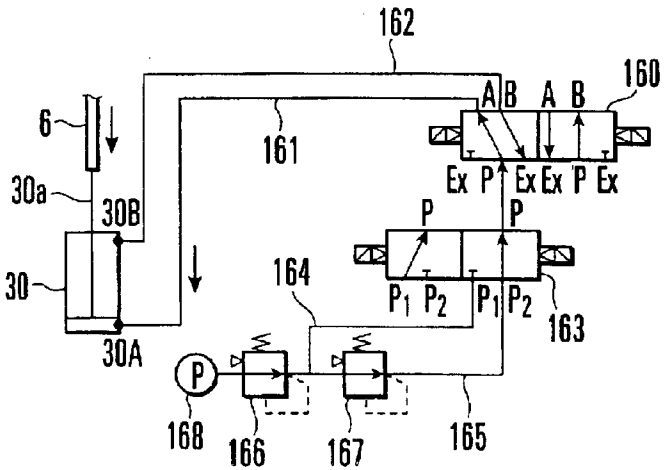
FIG. 17B is a circuit diagram of the air supply device in the state of moving the safety cover downward.

When the safety covers 6 that has moved upward is to be moved downward, the air cylinder driving solenoid valve 160 is set in the mode where the port P is connected to the port A and the port B is opened to the atmospheric pressure, in the same manner as in the case of upward movement described above. Also, the other solenoid of the switching solenoid valve 163 is actuated, so the solenoid valve 163 is switched to the mode where the port P is connected to the port $P_2$ (FIG. 17B). As described above, the pressure of air to be supplied to the port $P_2$ by the regulator 167 is set to be smaller than the force that pushes up the safety cover 6 against its weight. Even when the low-pressure air is supplied to the end-side port 30A that raises the safety cover 6, the safety cover 6 moves downward by its weight. At this time, the safety covers 6 moves downward slowly by the low-pressure air that is to move it upward against its weight. This moderates collision of the lower end of the safety cover 6 against other components, so the durability of the safety cover 6 is improved.

Figure 17C:
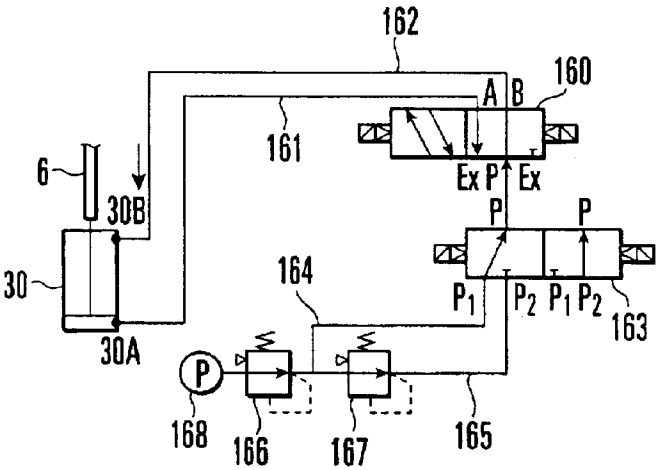
FIG. 17C is a circuit diagram of the air supply device in a state wherein the safety cover is held at the lower limit.

When the safety cover 6 moves downward and is positioned at the lower limit, the detection switches 38 (FIG. 3) detect it. The other solenoid of the air cylinder driving solenoid valve 160 is actuated, so the solenoid valve 160 is switched to the mode where the port P is connected to the port B and the port A is opened to the atmospheric pressure. Also, one solenoid of the switching solenoid valve 163 is actuated, so the switching solenoid valve 163 is switched to the mode where the port P is connected to the high-pressure port $P_1$ (FIG. 17C). Hence, a state wherein the safety cover 6 is located at the lower limit, i.e., a state wherein the safety cover 6 covers and closes the front portion of the plate cylinder 5, is held by the high-pressure air supplied from the high-pressure port $P_1$. As a result, the safety cover 6 can be regulated from moving upward intentionally or erroneously.

Figure 17D:
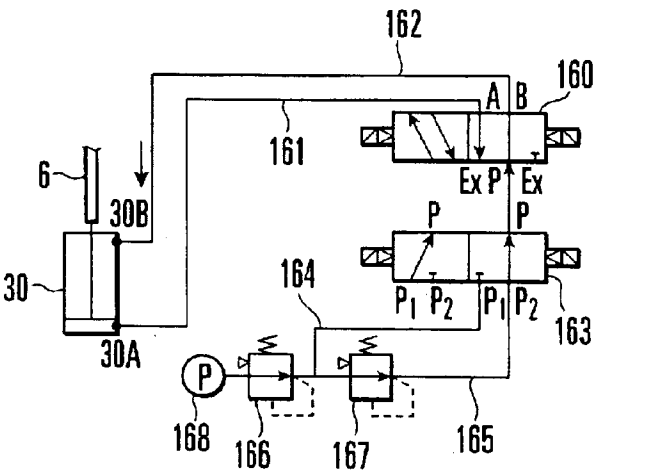
FIG. 17D is a circuit diagram showing another mode of the air supply device in a state wherein the safety cover is held at the lower limit.

The other solenoid of the switching solenoid valve 163 is actuated, so the switching solenoid valve 163 is switched to the mode where the port P is connected to the port $P_2$ (FIG. 17D). In this state as well, a state wherein the safety cover 6 is located at the lower limit, i.e., a state wherein the safety cover 6 covers and closes the front portion of the plate cylinder 5, is held by the high-pressure air supplied from the low-pressure port $P_2$. As a result, the safety cover 6 can be regulated from moving upward intentionally or erroneously.

When the safety cover 6 is moved upward, the plug-side unit 147 (FIG. 16) which forms the disconnecting/connecting device 145 moves upward together with the middle cover 6*b*. The socket-side unit 146 fixed to the frame 31 is kept fixed regardless of the movement of the safety cover 6. Therefore, the projections 154*b* and 155*b* of the plugs 154 and 155 are disengaged from the recesses 148*b* and 149*b* of the sockets 148 and 149 where they have been fitted, so that air supply from the air tubes 12 and 17 to the air tubes 13 and 18 is blocked.

According to this embodiment, the socket-side unit 146 connected to the suction pump 11 and discharge pump 16 through the air tubes 12 and 17 need not be moved. The air tubes 12 and 17 can accordingly be fixed in the apparatus, and a space for moving the air tubes 12 and 17 is not needed. Therefore, the paths for the air tubes 12 and 17 can be ensured within a limited space. When the safety cover 6 moves, air supply from the pumps 11 and 16 is automatically disconnected or connected interlocked with it. Thus, a detection means or control means that controls air supply by detecting movement of the safety cover 6 becomes unnecessary.

When the safety cover 6 is moved upward, air supply to the suction pads 102 connected through the air tubes 13, the air cylinders 41 of the plate holding devices 40A and 40B connected through the air tubes 18, and the air cylinder 113 of the suction pads 102 is blocked automatically. Therefore, after the safety cover 6 is moved upward to open the front portion of the plate cylinder 5 and the operation of the printing press is stopped, the suction pads 102 do not erroneously attract the plate, the plate holding devices 40A and 40B do not erroneously hold the plate, or the suction pads 102 are not erroneously moved, thus improving the convenience in use.

When the safety cover 6 moves downward from the upper position and the plug-side unit 147 moves downward together with the middle cover 6*b*, the plug-side unit 147 comes close to the socket-side unit 146. At this time, the positioning pin 158 of the plug-side unit 147 engages in the positioning hole 153 of the socket-side unit 146. After that, when the plug-side unit 147 moves further upward, the projections 154*b* and 155*b* of the plugs 154 and 155 are fitted in the recesses 148*b* and 149*b* of the sockets 148 and 149 smoothly and reliably.

When the safety cover 6 is moved upward, the plate feed unit 100 and engaging lever 138 (FIG. 12) move upward together with it, so that the engaging lever 138 and locking pin 142 disengage from each other. Therefore, the engaging lever 138 is pivoted clockwise in FIG. 12 about the small shaft 139 as the pivot center by the tensile force of the tensile coil spring 141. Thus, the engaging portion 138*a* of the engaging lever 138 engages with the engaging groove 136*a* of the swing regulating member 136.

For this reason, when the safety cover 6 is located at the upper position, the plate feed unit 100 can be regulated from being swung erroneously or intentionally and prevented from abutting against other constituent components erroneously, so that it can be prevented from being damaged. As the air cylinder 120 for swinging the plate feed unit 100 is supported by the stationary frame 31, the air cylinders 30 for moving upward the lower cover 6*c* to which the plate feed unit 100 is attached can be downsized.

When the safety cover 6 is moved upward, the pin 105 (FIG. 11B) engaging in the U-groove 123*a* of the engaging member 123 of the air cylinder 120 moves upward together with the plate feed unit 100, so that the U-groove 123*a* and pin 105 disengage from each other. In this manner, when the safety cover 6 is moved upward to open the front portion of the plate cylinder 5, the U-groove 123*a* and pin 105 disengage from each other, so the plate feed unit 100 is not erroneously swung by the air cylinder 120.

The plate feed unit 100 and air cylinder 120 are engaged with and disengaged from each other by the U-groove 123*a* of the engaging member 123 and the pin 105 provided to the plate feed unit 100. Thus, not only the number of components is reduced, but also the structure is simplified.

Similarly, the swing regulating means for regulating the swing of the plate feed unit 100, when the safety cover 6 is moved upward, is formed by the engaging lever 138, the engaging groove 136*a* engageable with it, and the locking pin 142. Thus, not only the number of components is reduced, but also the structure is simplified.

In this embodiment, the one-way clutches 45 and 46 are provided to the first and second rotary members 43 and 44, respectively. It suffices as far as a one-way clutch is provided to at least one rotary member. The plate holding devices 40A and 40B are moved upward once to move the old plate 25A upward, and after that they are moved downward to place the old plate 25A on the plate receiving member 103. Alternatively, after the old plate 25A is moved upward as shown in FIG. 23, the operator may extract it.

As has been described above, according to the present invention, not only the plate can be reliably removed from the plate cylinder, but also the plate holding device, the roller, and the like can be prevented from being broken or damaged. As the plate discharged from the plate cylinder is merely held and moved by the two rotary members, the structure is simplified. As the moving amounts of the two rotary members can be minimized, the driving source can be downsized.

The plate can be discharged after it is released by the plate holding means. Thus, discharge operation can be performed easily within a short period of time. The plate that has been moved upward once by the plate holding means is moved downward and supported by the plate receiving member. The height of the upper end of the supported plate decreases by an amount corresponding to the downward movement of the plate. This improves the discharge workability.

When the plate released by the plate holding means is to be held by the plate receiving member, the lower end of the plate is always in contact with the plate receiving member, and the first and second rotary members for holding the plate are allowed to rotate in the directions to disengage the plate from the plate cylinder. Therefore, the first and second rotary members do not damage the plate.

What is claimed is:

1. A plate holding apparatus comprising:

plate holding means for holding an old plate discharged from a plate cylinder; and driving means for moving said plate holding means between a first position of holding the discharged old plate and a second position away from said plate cylinder, wherein said plate holding means comprises a support member, a first rotary member rotatably, axially supported by said support member, a second rotary member axially supported by said support member to be movable and rotatable, moving means for moving said second rotary member to come into contact with and separate from said first rotary member, and a one-way clutch which, while the old plate is being held by said first and second rotary members, allows at least one of said first and second rotary members to rotate in a first direction to disengage the old plate from said plate cylinder, and regulates at least one of said first and second rotary members from rotating in a second direction opposite to the first direction.

2. An apparatus according to claim 1, wherein said plate holding means moves upward from the first position to the second position while holding an old plate, so the old plate disengages from said plate cylinder, and thereafter moves downward from the second position to the first position to release the held old plate.

3. An apparatus according to claim 2, further comprising a plate receiving member for holding the old plate released by said plate holding means at the first position.

4. An apparatus according to claim 3, wherein a distance between said plate holding means located at the first position and said plate receiving member is set to be smaller than a distance between said plate holding means located at the first position and the other end of the old plate held by said plate holding means.

5. An apparatus according to claim 3, wherein said apparatus further comprises a plate feed unit which is supported to be able to come close to and separate from said plate cylinder, to supply a new plate to be mounted to said plate cylinder, and said plate receiving member is attached to said plate feed unit on a plate cylinder side thereof.

6. An apparatus according to claim 1, wherein when said plate holding means is located at a wait position, one end of the old plate that has been removed from said plate cylinder passes between said first and second rotary members, and when said plate holding means moves upward from the wait position to the first position, said second rotary member is pressed against said first rotary member to hold the old plate.

7. An apparatus according to claim 1, wherein said moving means comprises a lever supported swingably at a central portion thereof and having one end which supports said second rotary member through said one-way clutch, a roller supported by the other end of said lever, a spring for biasing said lever in such a direction that said second rotary member comes close to said first rotary member, and a stopper which is fixed to a main body of said device and against which said roller abuts to interfere with pivot of said lever against a biasing force of said spring.

8. An apparatus according to claim 7, wherein when said plate holding means is located at a wait position close to said plate cylinder, pivot of said lever is interfered with by said stopper, so that said second rotary member separates from said first rotary member, and when said plate holding means moves upward from the wait position to the first position, said roller disengages from said stopper, so that said second rotary member comes into contact with said first rotary member.

* * * * *